US010271640B2

(12) United States Patent
Saotome

(10) Patent No.: US 10,271,640 B2
(45) Date of Patent: Apr. 30, 2019

(54) TABLETOP-EQUIPPED ARTICLE OF FURNITURE

(71) Applicant: OKAMURA CORPORATION, Yokohama-shi, Kanagawa (JP)

(72) Inventor: Hiroshi Saotome, Yokohama (JP)

(73) Assignee: OKAMURA CORPORATION, Kanagawa (JP)

( * ) Notice: Subject to any disclaimer, the term of this patent is extended or adjusted under 35 U.S.C. 154(b) by 0 days.

(21) Appl. No.: 15/575,149

(22) PCT Filed: May 20, 2016

(86) PCT No.: PCT/JP2016/065043

§ 371 (c)(1),
(2) Date: Nov. 17, 2017

(87) PCT Pub. No.: WO2016/186202

PCT Pub. Date: Nov. 24, 2016

(65) Prior Publication Data

US 2018/0140088 A1 May 24, 2018

(30) Foreign Application Priority Data

May 21, 2015 (JP) ..... 2015-103658
Jun. 11, 2015 (JP) ..... 2015-118526

(51) Int. Cl.
*A47B 13/02* (2006.01)
*A47B 13/00* (2006.01)

(52) U.S. Cl.
CPC ..... *A47B 13/02* (2013.01); *A47B 13/021* (2013.01); *A47B 13/003* (2013.01);
(Continued)

(58) Field of Classification Search
CPC ..... A47B 13/02
(Continued)

(56) References Cited

U.S. PATENT DOCUMENTS 145,174 A * 12/1873 Harden ..... F16M 11/32 182/181.1
609,592 A * 8/1898 Schultz ..... A47B 3/12 108/150

(Continued)

FOREIGN PATENT DOCUMENTS

EP 2 070 439 6/2009
JP 62-098531 6/1987

(Continued)

OTHER PUBLICATIONS

International Search Report for PCT/JP2016/065043 dated Jun. 28, 2016.

(Continued)

*Primary Examiner* — Jose V Chen
(74) *Attorney, Agent, or Firm* — Nixon Peabody LLP; Jeffrey L. Costellia

(57) ABSTRACT

The present invention relates to a tabletop attached furniture (10, 10A, 10B, 10C) including a plurality of legs (20) which stand on a floor surface (F) and a tabletop (30, 30A, 30B, 30C) supported on the plurality of legs (20), wherein each of the legs (20) is formed so that a width dimension (W1) when viewed from a first direction (X) along an upper surface of the tabletop (30, 30A, 30B, 30C) gradually increases upward from below and a width dimension (W2) when viewed from a second direction (Y) orthogonal to the first direction (X) within a plane following the upper surface of the tabletop gradually increases downward from above.

10 Claims, 19 Drawing Sheets

(52) U.S. Cl.
CPC . *A47B 2200/002* (2013.01); *A47B 2200/0013* (2013.01); *A47B 2200/0063* (2013.01)

(58) Field of Classification Search
USPC ..... 108/154, 153.1; 248/188.1, 168, 158, 248/165, 150, 121, 127
See application file for complete search history.

(56) References Cited

U.S. PATENT DOCUMENTS 1,426,962 A * 8/1922 Corpstein ..... A47B 3/10 108/35
3,081,841 A 3/1963 Mauro et al.
3,295,475 A * 1/1967 McClellan ..... A47B 3/0918 108/116
D229,808 S * 1/1974 McDonald ..... D6/691
4,105,091 A * 8/1978 Mahan ..... B23D 51/025 182/151
4,182,432 A * 1/1980 Cossitt ..... B25H 1/06 182/151
4,321,875 A * 3/1982 Danko ..... A47B 13/02 108/150
4,354,437 A * 10/1982 Logan ..... A47B 3/00 108/128
4,765,253 A 8/1988 Schappach
4,860,667 A * 8/1989 Cardenas ..... A47B 3/00 108/115
4,972,781 A 11/1990 Montgomery et al.
5,953,874 A * 9/1999 Hoffman ..... E02D 27/01 52/294
6,364,133 B1 * 4/2002 Sheng ..... B42F 15/0094 211/189
6,619,601 B1 9/2003 Vall
6,938,556 B1 * 9/2005 Reyes ..... A47B 13/00 108/25
6,968,790 B1 * 11/2005 Kocsis ..... A47B 83/02 108/11
7,124,695 B2 * 10/2006 Buechler ..... A47B 45/00 108/180
D613,097 S * 4/2010 Muller ..... D6/708
D650,204 S * 12/2011 Muller ..... D6/708
D685,595 S * 7/2013 Hendrick ..... D6/691
D750,405 S * 3/2016 Muller ..... D6/708.17
9,814,308 B2 * 11/2017 Hoff ..... A47B 13/02
2016/0345739 A1 * 12/2016 McCullough ..... A47C 4/02

FOREIGN PATENT DOCUMENTS

JP 01-178733 12/1989
JP 3349453 9/2002
JP 2003-189945 7/2003

OTHER PUBLICATIONS

Written Opinion for PCT/JP2016/065043 dated Jun. 28, 2016.
Japanese Office Action issued in Japanese Application No. 2015-118526 dated Dec. 21, 2018, with English translation.

* cited by examiner

TABLETOP-EQUIPPED ARTICLE OF FURNITURE

TECHNICAL FIELD

The present invention relates to a tabletop-equipped article of furniture (an appliance constituting an appliance system) such as a table. Priority is claimed on Japanese Patent Application No. 2015-103658 filed on May 21, 2015 and Japanese Patent Application No. 2015-118526 filed on Jun. 11, 2015, the contents of which are incorporated herein by reference.

BACKGROUND ART

A table used for various kinds of meetings, tasks, and meals includes a tabletop and support legs supporting the tabletop. As such a table, for example, as disclosed in Patent Document 1, a table having a configuration in which an installation position of a lower end of each support leg on a floor surface is located at the outside relative to a connection position of an upper end of each support leg on the tabletop is known. Since such a table is provided in such a manner that the plurality of support legs divergently extend downward from above, the stability of the table is improved.

Additionally, for example, the table disclosed in Patent Document 1 has a configuration in which the tabletop extends in an elongated manner in one direction in the plan view. A frame which is continuously formed in a long side direction of the tabletop is provided on a lower surface of the tabletop.

Among makers that manufacture and sell such tables, there are cases in which a plurality of types of tables with different tabletop sizes and shapes are provided in a common design style as product development. In such a case, the attachment positions of the legs on the tabletop are set depending on the size and shape of the tabletop. Thus, for example, even in the tabletops having a common design style, the attachment positions of the legs on the lower surface of the tabletop are different in response to the size of the tabletop.

CITATION LIST

Patent Document

[Patent Document 1]
Japanese Patent No. 3349453

SUMMARY OF INVENTION

Technical Problem

In the above-described table, there is a possibility that the support legs or joint portions between the tabletop and the support legs may be deformed or damaged due to a load applied to the tabletop when various articles are placed on the tabletop or a person leans on the tabletop. In order to prevent such deformation or damage, the table needs to have sufficient strength. As one method, a method of increasing the thickness of the support legs is considered.

Meanwhile, when the support legs are thick, there are cases in which the support legs interfere with a leg of a user below the tabletop. Particularly when a plurality of users use the table and the users sit at various positions around the tabletop in response to task content or the number of users, the leg of the user easily interferes with the support legs.

Here, a first object of the present invention is to provide a tabletop-equipped article of furniture with support legs capable of suppressing interference with a leg of a user while ensuring necessary strength.

Additionally, in order to change the attachment positions of the legs to the tabletop in response to the size or shape of the tabletop, there is a need to change the positions of screw holes through which bolts tor fixing the legs to the tabletop are inserted. Thus, since the screw holes need to be processed in response to the positions set depending on the size or shape of the tabletop, it takes time and effort. Here, a second object of the present invention is to provide a tabletop-equipped article of furniture (an appliance constituting an appliance system) in which attachment positions of legs can be easily changed in response to a size or shape of an upper structure such as a tabletop.

Solution to Problem

The present invention employs the following means in order to solve the above-described problems. A first aspect of the present invention is tabletop-equipped article of furniture including: a plurality of legs which stand on a floor surface; and a tabletop which is supported on the plurality of legs, wherein each of the legs is formed so that a width dimension when viewed from a first direction along an upper surface of the tabletop gradually increases upward from below and a width dimension when viewed from a second direction orthogonal to the first direction within a plane along the upper surface of the tabletop gradually increases downward from above.

In this way, since the width dimension of the legs when viewed from the first direction gradually increases upward from below, it is possible to ensure strength at the joint portions between the legs and the upper tabletop. Further, since the lower portions of the legs are thin, the interference with the leg of the user can be suppressed. Further, since the width dimension of the legs when viewed from the second direction gradually increases downward from above, the upper portions of the legs are located at the inside of the tabletop particularly between the tabletop and the floor surface. Thus, an upper space close to the tabletop can be widely ensured. Thus, a knee of the leg of the user hardly interferes with the legs.

Further, a second aspect of the present invention is the tabletop-equipped article of furniture of the first aspect, wherein the first direction is a direction facing the tabletop from a frequently used side and the second direction is a direction facing the tabletop from a less frequently used side. With such a configuration, the leg of the user facing the tabletop hardly interferes with the legs at a side where the tabletop is frequently used.

Further, a third aspect of the present invention is the tabletop-equipped article of furniture of the first aspect or the second aspect, wherein the first direction is a direction facing the legs from a side where an overhang dimension of the tabletop overhanging laterally is small and the second direction is a direction facing the legs from a side where the overhang dimension of the tabletop overhanging laterally is large. With such a configuration, the second direction follows a direction in which the overhang dimension is large. Since the width dimension of the legs when viewed from the first direction gradually increases upward from below, the joint portions between the legs and the tabletop have high strength against a load or force in the second direction and the vertical direction. Thus, the legs can exhibit high strength against a load or force applied to a portion in which the overhang dimension of the tabletop is large.

Further, a fourth aspect of the present invention is the tabletop-equipped article of furniture of any one of the first aspect to the third aspect, wherein the first direction is a short side direction of the tabletop and the second direction is a long side direction of the tabletop. With such a configuration, since the width dimension of the legs when viewed from the first direction gradually increases upward from below, the joint portions between the legs and the tabletop have high strength against a load or force in the vertical direction and the long side direction of the tabletop corresponding to the second direction. Further, since the width dimension of the legs when viewed from the second direction gradually increases downward from above, the leg of the user facing the tabletop from the short side direction of the tabletop corresponding to the first direction hardly interferes with the upper portions of the legs.

Further, a fifth aspect of the present invention is the tabletop-equipped article of furniture of any one of the first aspect to the fourth aspect, wherein the legs are provided to be inclined so that gaps between pairs of the legs facing each other in the second direction gradually increase downward from above. With such a configuration, a force is applied in a direction in which the pairs of legs widen in the second direction by a load acting on the tabletop. Since the width dimension of the legs when viewed from the first direction gradually increases upward from below, the joint portions between the legs and the tabletop have high strength against a load or force in the second direction and the vertical direction. Thus, it is possible to suppress the legs from widening in the second direction while gaps between the pairs of legs gradually widen downward from above.

Further, a sixth aspect of the present invention is the tabletop-equipped article of furniture of any one of the first aspect to the fifth aspect, wherein the legs are formed as panel bodies which have trapezoidal shapes when viewed from the first direction or the second direction. With such a configuration, in the legs having the trapezoidal panel shapes, the width dimension when viewed from the first direction gradually increases upward from below and the width dimension when viewed from the second direction gradually increases downward from above. Thus, it is possible to obtain the tabletop-equipped article of furniture with the legs having a characteristic appearance.

Further, a seventh aspect of the present invention is the tabletop-equipped article of furniture of the first aspect to the fifth aspect, wherein the legs includes pairs of leg portions separated from each other in the first direction and connection members connecting the pairs of leg portions to each other. With such a configuration, in the legs in which the pairs of leg portions are connected to each other by the connection member, the width dimension when viewed irons the first direction gradually increases upward from below and the width dimension when viewed from the second direction gradually increases downward from above. Thus, it is possible to obtain the tabletop-equipped article of furniture with the legs having a characteristic appearance.

Further, an eighth aspect of the present invention is the tabletop-equipped article of furniture of the seventh aspect, wherein, when lower surfaces of the connection members are formed above lower ends of the leg portions and the legs are installed on the floor surface, gaps are formed between the floor surface and the lower surfaces of the connection members. With such a configuration, wires or the like can pass through the gaps between the floor surface and the lower surfaces of the connection members constituting the legs. Thus, when the wires or the like arc provided along the floor surface, it is possible to prevent the interference between the leg of the user and the wires. Further, when the wires are provided from the floor surface toward the tabletop through the legs, the wires can be guided into the legs from the lower portions of the connection members through the gaps between the floor surface and the lower surfaces of the connection members.

Additionally, a ninth aspect of the present invention is tabletop-equipped article of furniture (an appliance constituting an appliance system) including: legs which stand on a floor surface; beams which are connected to the legs and extend in one direction intersecting a vertical direction; and a tabletop (an upper structure) which is supported by the beams, wherein connection positions of the leg with the beams are changeable along the beams in response to a length of the tabletop in the one direction when the tabletop has different lengths in the one direction.

According to such a configuration, it is possible to change the connection positions of the legs with the beams along the beams in response to the length of the tabletop in one direction by using the beams having the same length for the tabletops (the upper structures) having different lengths in one direction. Thus, there is no need to prepare beams having various lengths for the tabletops having different lengths in one direction and the length of the beams can be commonly set. Accordingly, it is possible to constitute the tabletop-equipped article of furniture (the appliance constituting the appliance system) with a small number of components and to commonly set the beam attachment structure for the tabletop.

Further, a tenth aspect of the present invention is the tabletop-equipped article of furniture (the appliance constituting the appliance system) of the ninth aspect, wherein the beams include grooves formed to extend in the one direction, and wherein the tabletop-equipped article of furniture further includes connection tools which are movable along the grooves and connect the beams to the legs. In this way, it is possible to improve a degree of freedom in the connection positions between the beams and the legs by the connection tools moving in the grooves formed in the beams. Accordingly, it is possible to easily change the positions of the legs with respect to the tabletop (the upper structure) within the ranges along the grooves.

Advantageous Effects of Invention

According to the tabletop-equipped article of furniture of the present invention, it is possible to ensure the leg accommodation space for accommodating the leg of the user below the tabletop while ensuring the strength of the legs. In addition, according to the tabletop-equipped article of furniture (the appliance constituting the appliance system) of the present invention, the leg attachment positions can be easily changed in response to the shape or size of the upper structure such as the tabletop.

DESCRIPTION OF EMBODIMENTS (First Embodiment)

Hereinafter, a first embodiment of table top-equipped article of furniture according to the present invention will be described with reference to FIGS. 1 to 7 of the accompanying drawings. However, the present invention is not limited to the first embodiment.

Figure 1:
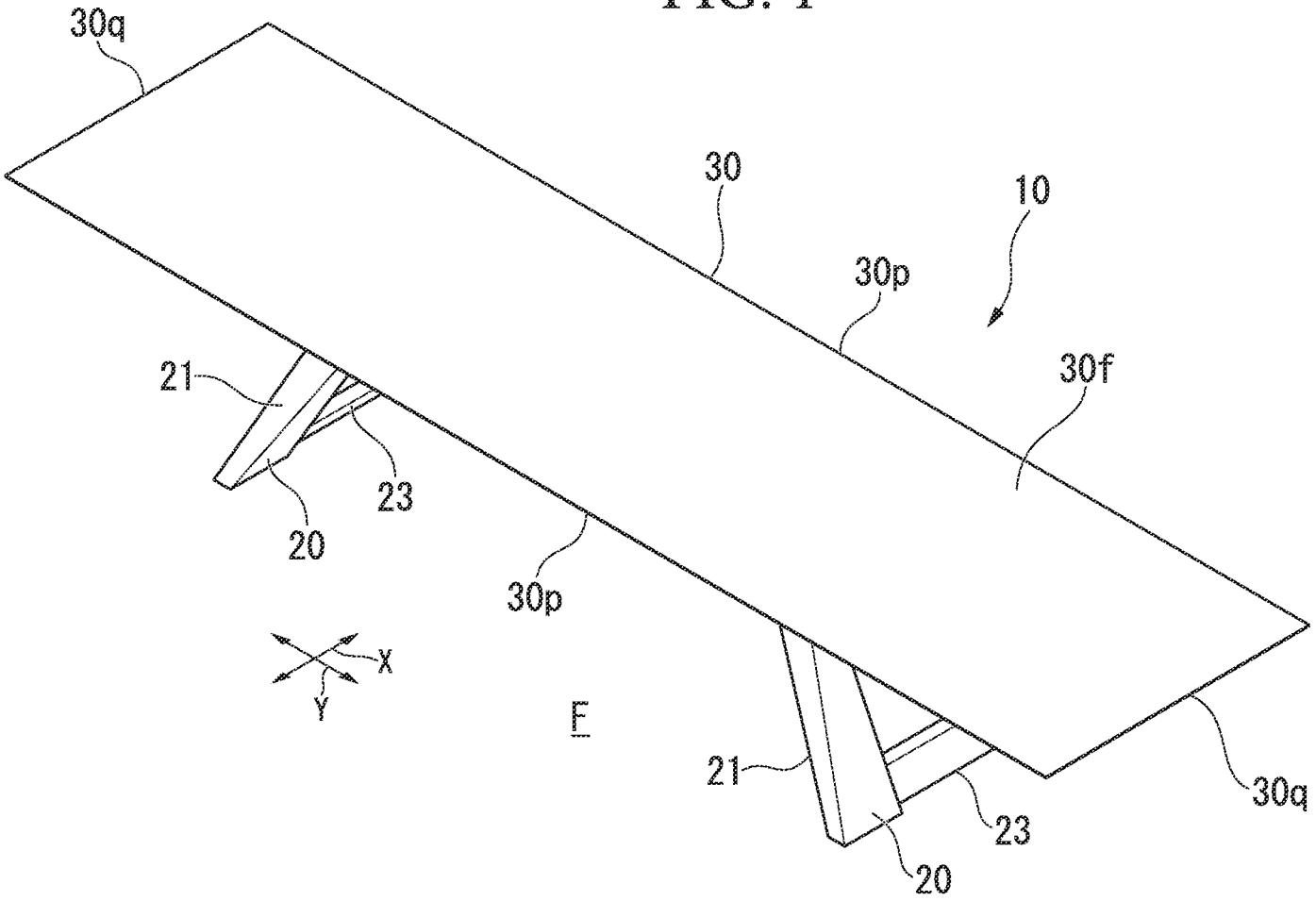
FIG. 1 is a perspective view showing an overall configuration of a table according to a first embodiment of the present invention.
Figure 2:
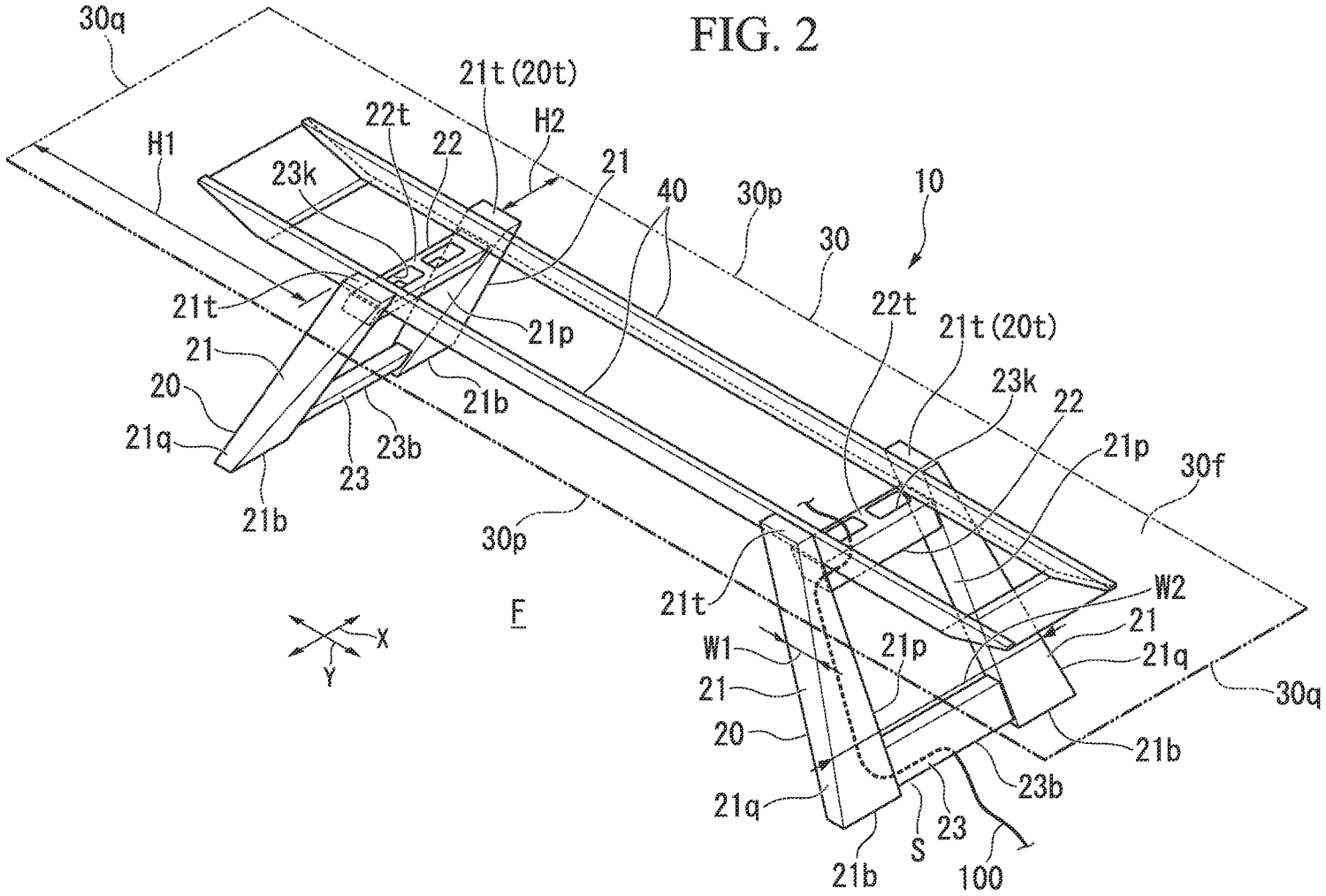
FIG. 2 is a perspective view showing a configuration of legs of the table.
Figure 3:
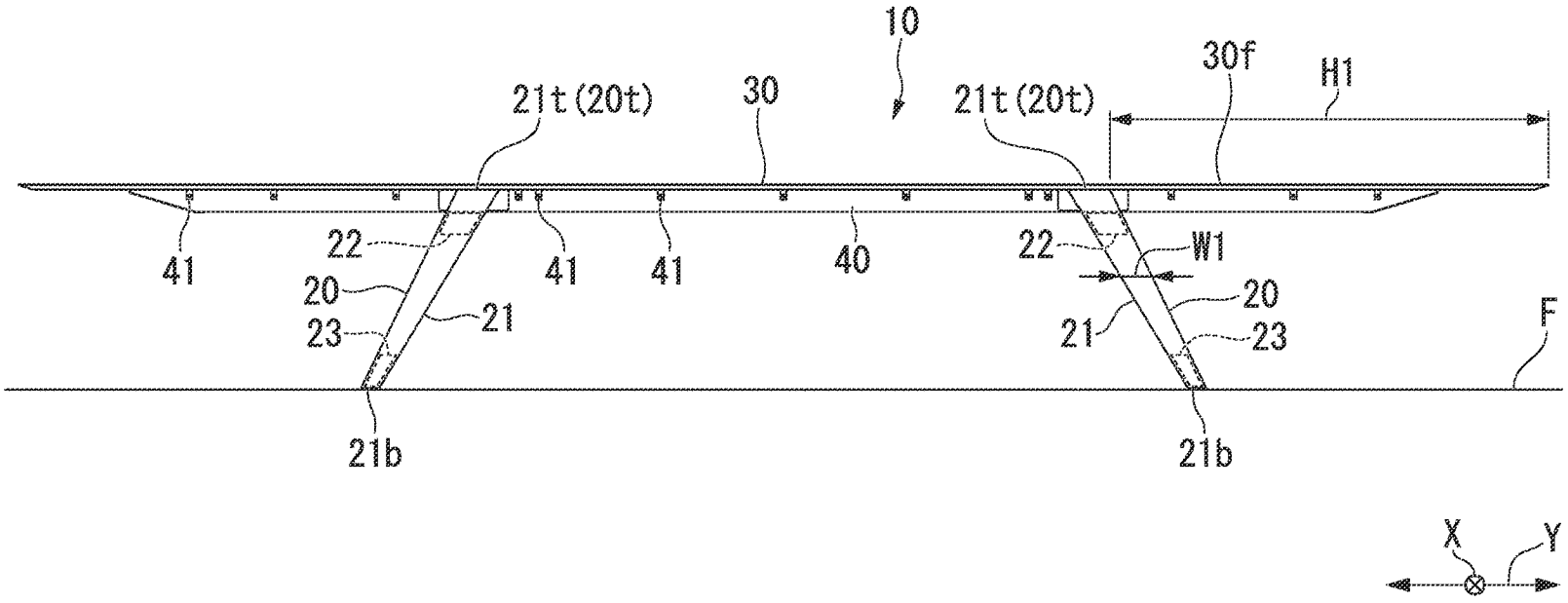
FIG. 3 is a diagram showing the table from a first direction.
Figure 4:
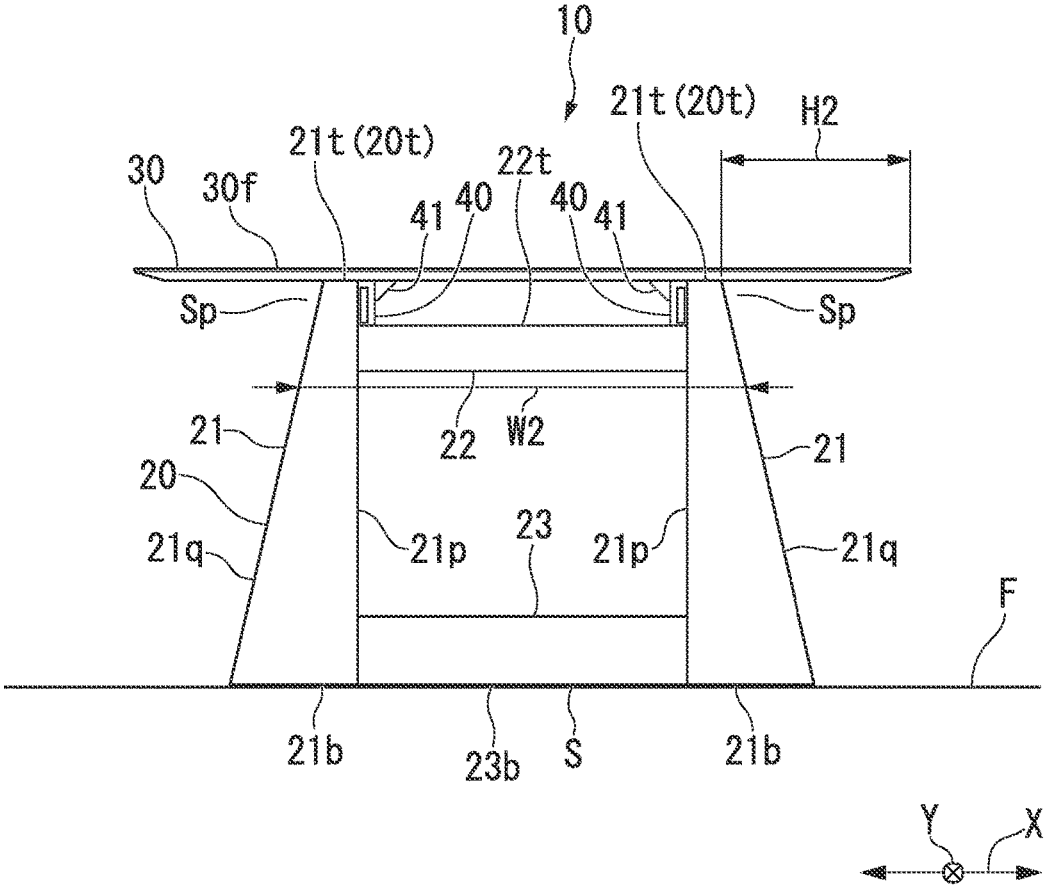
FIG. 4 is a diagram showing the table from a second direction.

FIG. 1 is a perspective view showing an overall configuration of a table according to a first embodiment of the present invention. FIG. 2 is a perspective view showing a configuration of legs of the table. FIG. 3 is a diagram showing the table from a first direction. FIG. 4 is a diagram showing the table from a second direction. As shown in FIG. 1, a table (tabletop-equipped article of furniture) 10 includes a plurality of legs 20 which stand on a floor surface F and a tabletop 30 which is supported on the plurality of legs 20. In the table 10 of the first embodiment, the tabletop 30 has, for example, a rectangular shape in the plan view and is formed to be short in a first direction X along an upper surface 30*f* and to be long in a second direction Y orthogonal to the first direction X within a plane along the upper surface 30*f*. The shape of the tabletop 30 in the plan view is not limited to a rectangular shape, but may be an oval shape, an elliptical shape, or the like.

As shown in FIGS. 2 to 4, beams 40 which extends in the second direction Y corresponding to the long side direction of the tabletop 30 are provided on the lower surface of the tabletop 30. The pair of beams 40 are provided to be separated from each other by a predetermined gap in the first direction X corresponding to the short side direction of the tabletop 30. The beams 40 are provided at a plurality of positions separated from each other in the long side direction (the second direction Y) and are fixed to the lower surface of the tabletop 30 through attachment metal pieces 41.

The legs 20 are provided at one end side and the other end side of the tabletop 30 in the second direction Y. Each leg 20 includes leg members (leg portions) 21 which are provided at both end portions in the first direction X, an upper connection member (a connection member) 22 which connects the upper portions of the leg members 21 to each other, and a lower connection member (a connection member) 23 which connects the lower portions of the leg members 21 to each other.

As shown in FIGS. 2 and 4, the upper connection members 22 are provided so that upper surfaces 22*t* are located below upper ends 21*t* of the leg members 21 by a predetermined dimension. The beams 40 are disposed on the upper surfaces 22*t* of the upper connection members 22, and the upper connection members 22 and the beams 40 are connected to each other.

The lower connection members 23 ate provided so that lower surfaces 23*b* are located above lower ends 21*b* of the leg members 21 by a predetermined dimension. Accordingly, gaps S are formed between the floor surface F and the lower surfaces 23*b* of the lower connection members 23 between the leg members 21 while the leg members 21 of the legs 20 contact the floor surface F. Various wires 100 can be inserted through the lower portions of the lower connection members 23 through the gaps S.

As shown in FIGS. 2 and 3, each leg member 21 is formed so that a width dimension W1 in the second direction Y when viewed from the first direction X gradually increases upward from below. Each leg member 21 is provided to be inclined so that the lower end 21*b* is located at the outside in the width direction of the table 10 in the second direction Y relative to the upper end 21*t* when viewed from the first direction X. Accordingly, the pair of legs 20 facing each other in the second direction Y are disposed in a substantially inverted V shape so that a gap between the legs 20 gradually increases downward from above.

Further, as shown in FIGS. 2 and 4, each leg member 21 is formed such that an inner surface 21*p* located at the inside in the width direction of the table 10 in the first direction X becomes a vertical plane orthogonal to the floor surface F when viewed from the second direction Y. In the leg members 21, outer surfaces 21*q* which are located at the outside in the longitudinal direction of the table 10 in the first direction X ate formed as inclined surfaces which are gradually separated from the inner surfaces 21*p* in a direction along the first direction X from the upper ends 21*t* of the leg members 21 toward the lower ends 21*b*. Accordingly, the legs 20 are formed so that a width dimension W2 when viewed from the second direction Y gradually increases downward from above.

As shown in FIG. 2, the legs 20 are formed in, for example, hollow structures and may be formed so that the wires 100 can be arranged through opening portions 23*k* formed in the upper surfaces 22*t* of the upper connection members 22 from opening portions (not shown) formed in the lower surfaces of the lower connection members 23 to the inside of the leg members 21. In this case, in the leg members 21, the wires 100 along the floor surface F can be guided into the legs 20 through the gaps S formed between the lower connection members 23 and the floor surface F.

As shown in FIGS. 2 to 4, the tabletop 30 is provided to overhang outward m the longitudinal direction along the first direction X and outward in the width direction along the second direction Y relative to the upper ends 20*t* of the legs 20. An overhang dimension H1 of the tabletop 30 in the second direction Y is set to be larger than an overhang dimension H2 in the first direction X. That is, the first direction X is a direction that faces the tabletop 30 from a side having a small overhang dimension H2 and the second direction Y is a direction that feces the tabletop 30 from a side having a large overhang dimension H1.

In the table 10 with the above-described configuration, since the width dimension W1 of the legs 20 when viewed from the first direction X gradually increases upward from below as shown in FIG. 4, it is possible to ensure the strength at the joint portions between the upper portions of the legs 20 and the tabletop 30. Further, since the width dimension W2 of the legs 20 at the lower portion of the legs 20 decreases, it is possible to suppress the interference between the legs 20 and the leg of the user. Further, as shown in FIG. 3, since the width dimension W2 of the legs 20 when viewed from the second direction Y gradually increases downward from above, the upper portion of the legs 20 is located at the inside of the tabletop 30 in the first direction X and thus an upper space close to the tabletop 30 can be widely ensured. Thus, a knee of the leg of the user hardly interferes with the legs 20. With such a configuration, it is possible to ensure a leg accommodation space Sp below the tabletop 30 while ensuring the strength.

Here, the first direction X is the short side direction of the tabletop 30 and the second direction Y is the long side direction of the tabletop 30. With such a configuration, the joint portions between the legs 20 and the tabletop 30 have high strength against a load or force in the vertical direction and the second direction Y, that is, the long side direction of the tabletop 30 corresponding to the second direction Y. Further, in the leg 20, the leg of the user who feces the tabletop 30 from the short side direction of the tabletop 30 corresponding to the first direction X hardly interferes with the upper portions of the legs 20. In this way, in the tabletop 30 having an elongated shape in one direction, the number of the users facing the tabletop 30 at a long side 30*p* along the long side direction (the second direction Y) is generally larger than the number of the users facing the tabletop 30 at a short side 30*q* along the short side direction (the first direction X). That is, the first direction X is a direction facing the tabletop 30 from a side where a large n umber of users use the tabletop and the second direction Y is a direction facing the tabletop 30 from a side where a small number of users use the tabletop 30. Accordingly, the leg of the user facing the tabletop 30 hardly interferes with the legs 20 when viewed from a side where a large number of users use the tabletop 30.

Further, the first direction X is a direction facing the legs 20 from a side where the overhang dimension H2 of the tabletop 30 overhanging laterally is small and the second direction Y is a direction facing the legs 20 from a side where the overhang dimension H1 of the tabletop 30 overhanging laterally is large. Since the width dimension W1 of the legs 20 when viewed from the first direction X gradually increases upward from below, the legs 20 have high strength at the joint portions with the tabletop 30 against a load or force in the second direction Y and the vertical direction. Thus, the legs 20 can effectively exhibit strength against a load or force applied to a portion in which the overhang dimension H2 of the tabletop 30 is large.

Further, in the table 10, each leg 20 is provided to be inclined so that gaps between the pairs of legs 20 facing each other in the second direction Y gradually increases downward from above. With such a configuration, a force of widening the pairs of legs 20 in the second direction Y is exhibited by a load or the like acting on the tabletop 30. Since the width dimension W1 of the legs 20 when viewed from the first direction X gradually increases upward from below, the legs 20 have high strength at the joint portions with the tabletop 30 against a force or load in the second direction Y and the vertical direction. Thus, since gaps between the pairs of legs 20 gradually increase downward from above, the legs 20 do not widen much in the second direction Y and thus can exhibit high strength.

Further, the legs 20 are formed such that the pairs of leg members 21 are connected by the upper connection members 22 and the lower connection members 23. In these legs 20, the width dimension W1 gradually increases upward from below when viewed from the first direction X and the width dimension W2 gradually increases downward from above when viewed from the second direction Y. Thus, it is possible to obtain the table 10 with the legs 20 having a characteristic appearance.

Additionally, in the table 10, since the lower surfaces 23*b* of the lower connection members 23 are formed above the lower ends of the leg members 21, the gaps S are formed between the floor surface F and the lower surfaces 23*b* of the lower connection members 23 when the legs 20 are installed on the floor surface F. Accordingly, the wires 100 or the like can pass through the gaps S between the lower surfaces 23*b* of the lower connection members 23 constituting the legs 20 and the floor surface F. Thus, when the wires 100 or the like are provided along the floor surface F, it is possible to prevent the interference between the leg of the user and the wires 100. Further, when the wires 100 are arranged from the floor surface F to the tabletop 30 through the legs 20, the wires 100 can be guided into the legs 20 from the lower portions of the lower connection members 23 through the gaps S between the lower surfaces 23*b* of the lower connection members 23 and the floor surface F.

(Other Embodiments)

Figure 5:
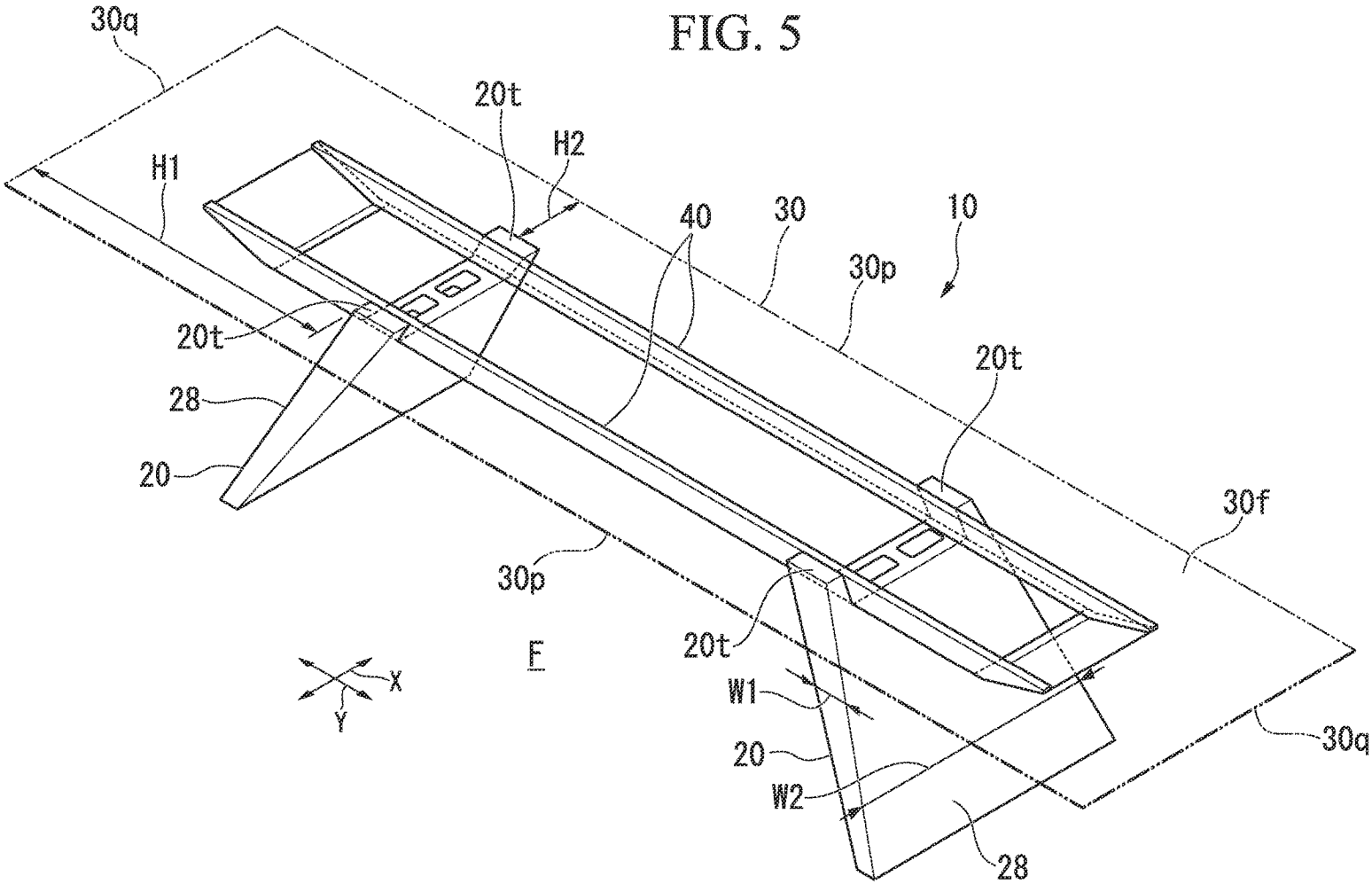
FIG. 5 is a perspective view showing a modified example of the legs of the table.

Additionally, the tabletop-equipped article of furniture of the present invention is not limited to the above-described embodiment described with reference to the drawings and various modifications can be considered within the technical scope. FIG. 5 is a perspective view showing a modified example of the legs of the table. For example, as shown in FIG. 5, the legs 20 may be formed as panel bodies 28 which have trapezoidal shapes when viewed from the first direction X or the second direction Y. With such a configuration, in such legs 20 having trapezoidal panel, shapes, the width dimension W1 gradually increases upward from below when viewed from the first direction X and the width dimension W2 gradually increases downward from above when, viewed from the second direction Y. Thus, it is possible to obtain the table 10 with the legs 20 having a characteristic appearance. Further, when the legs 20 are formed in trapezoidal shapes, the legs 20 themselves have wide widths and thus the strength of the legs 20 can be improved.

Figure 6:
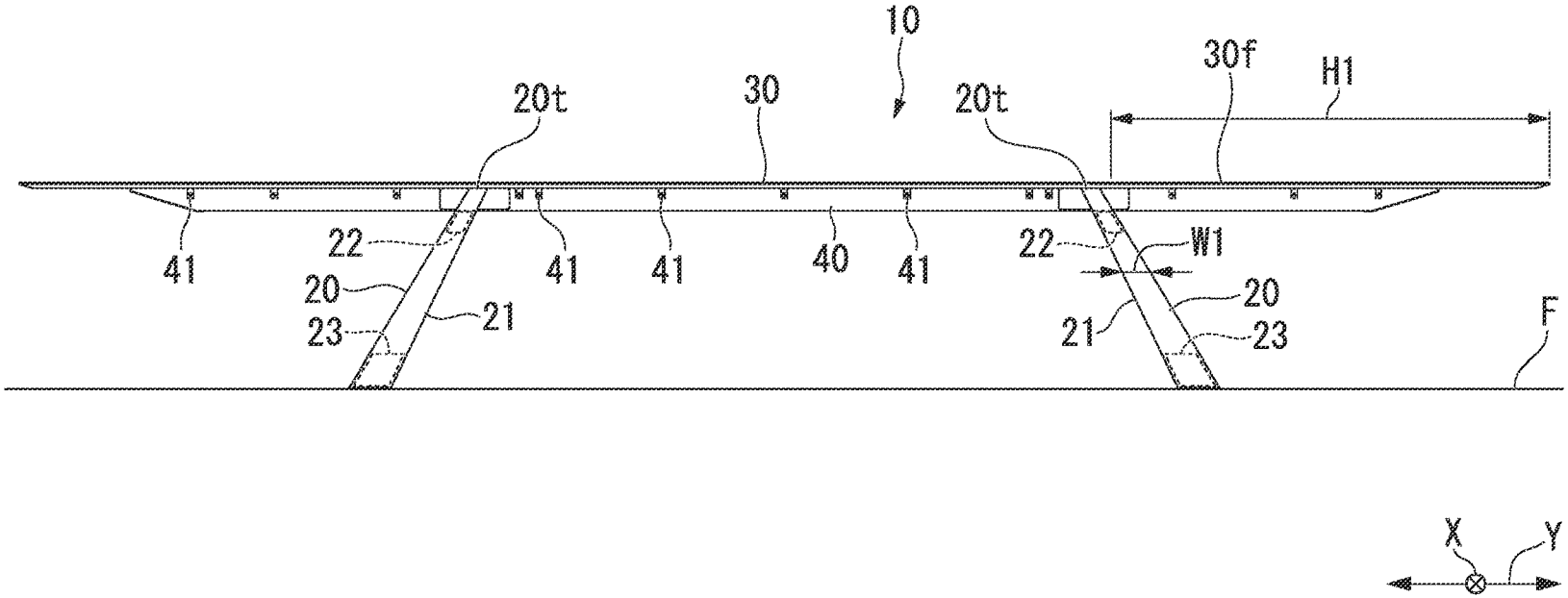
FIG. 6 is a diagram showing another modified example of the legs of the table and is a diagram showing the table from a first direction.
Figure 7:
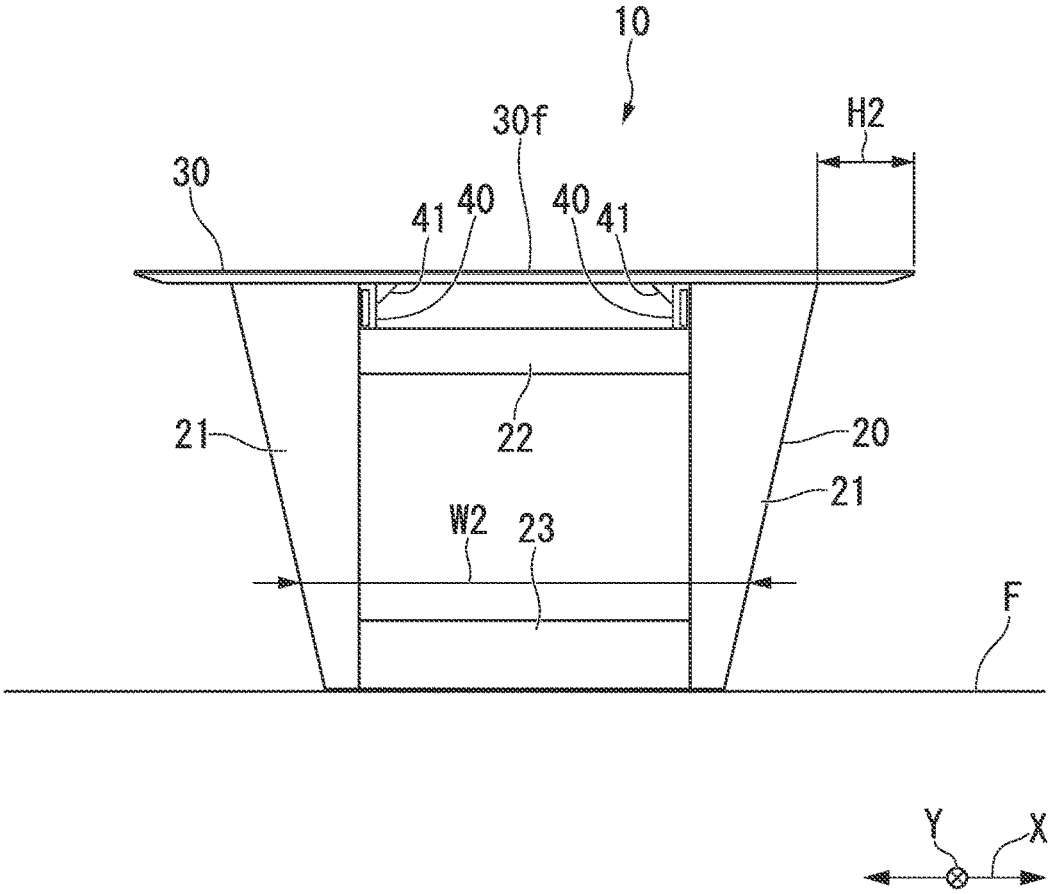
FIG. 7 is a diagram showing another modified example of the legs of the table and is a diagram showing the table from a second direction.

Further, in the first embodiment, the legs 20 are formed such that the width dimension W1 gradually increases upward from below when viewed from the first direction X and the width dimension W2 gradually increases downward from above when viewed from the second direction Y, but the present invention is not limited thereto. FIG. 6 is a diagram showing another modified example of the legs of the table and is a diagram showing the table from the first direction. FIG. 7 is a diagram showing another modified example of the legs of the table and is a diagram showing the table from the second direction. As shown in FIGS. 6 and 7, the legs 20 may be formed such that the width dimension W1 gradually increases downward from above when viewed from the first direction X and the width dimension W2 gradually increases upward from below when viewed from the second direction Y.

Further, in the first embodiment, the leg members 21 constituting the legs 20 are connected by the upper connection members 22 and the lower connection members 23, but the present invention is not limited thereto. The leg members 21 constituting the legs 20 may be connected by only the upper connection members 22 or only the lower connection members 23. Further, the legs 20 may include only the leg members 21 without the upper connection members 22 and the lower connection members 23. In this case, when each leg member 21 has a known configuration of the present invention, the above-described operation and effect can be obtained. However, the present invention is not limited thereto and the legs 20 may adopt a configuration other than a configuration including shapes of the legs 20 shown in the first embodiment and the modified, examples thereof.

Further, the pairs of legs 20 facing each other in the second direction Y are provided so that gaps between the legs 20 gradually increase downward from above and are arranged in a substantially inverted V shape, but the present invention is not limited thereto. The pairs of legs 20 may be arranged in parallel to extend upward vertically from the floor surface F. Further, the pairs of legs 20 may be arranged in a substantially V shape so that gaps between the legs 20 gradually decrease downward from above.

Further, materials of members such as the legs 20 and the tabletop 30 constituting the table 10 indicated by the first embodiment are not limited. Such members may be formed of for example, a wood material, a metal material a resin material, or a combination thereof. In addition, the present invention is not limited to the table 10 and can be also applied to other tabletop-equipped article of furniture such as a counter. In addition, a configuration exemplified in the first embodiment and the modified examples thereof may be selected or may be replaced by other configurations without departing from the spirit of the present invention.

(Second Embodiment)

Hereinafter, a second embodiment of the tabletop-equipped article of furniture (the appliance used in the appliance system) according to the present invention will be described with reference to FIGS. 8 to 19 of the accompanied drawings. However, the present invention is not limited to the second embodiment. Additionally, the same reference numerals are given to the same components as those of the tabletop-equipped article of furniture 10 in FIGS. 1 to 9 showing the first embodiment and the modified example thereof.

Figure 8:
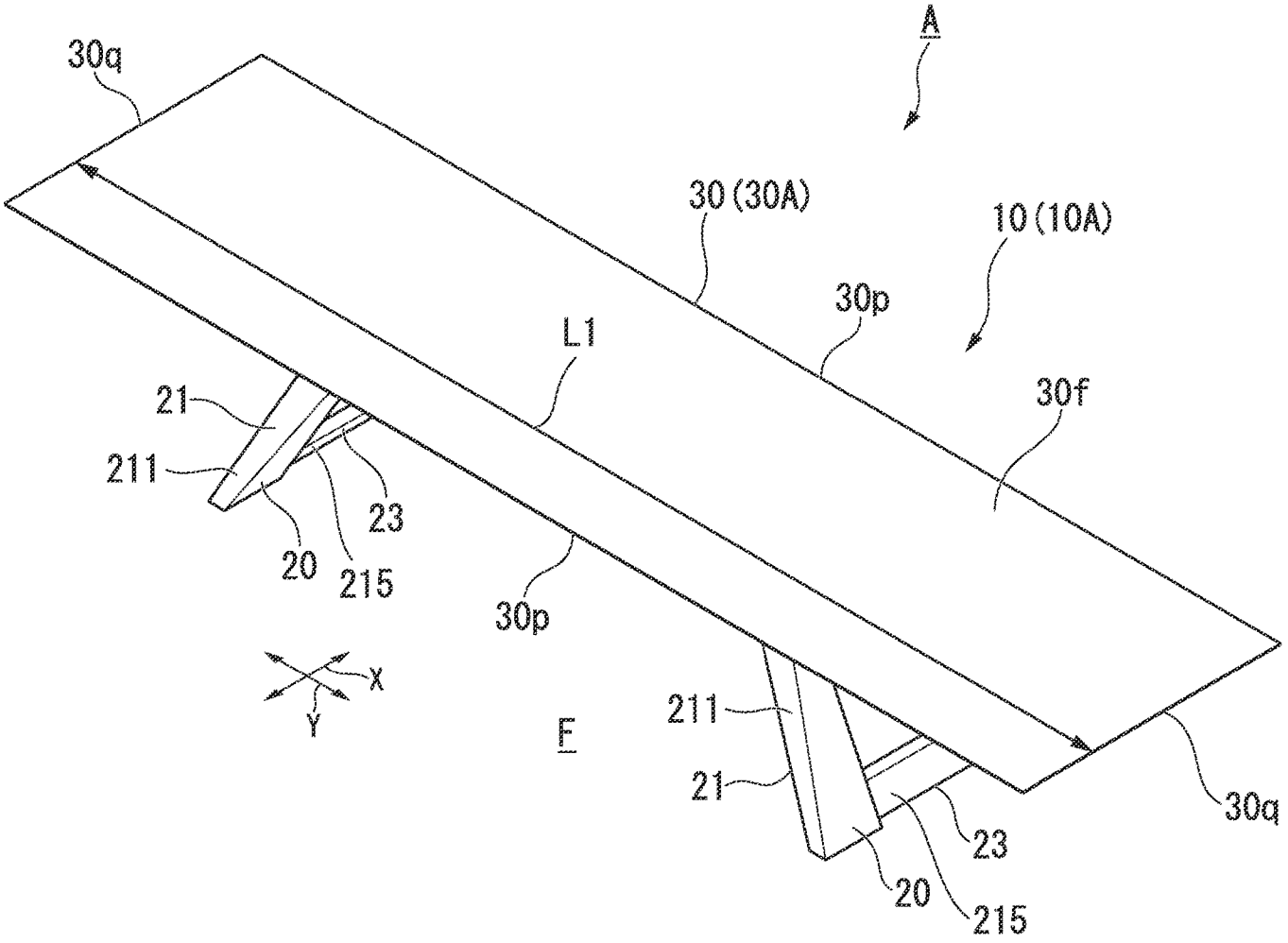
FIG. 8 is a perspective view showing an overall configuration of a table according to a second embodiment of the present invention.
Figure 9:
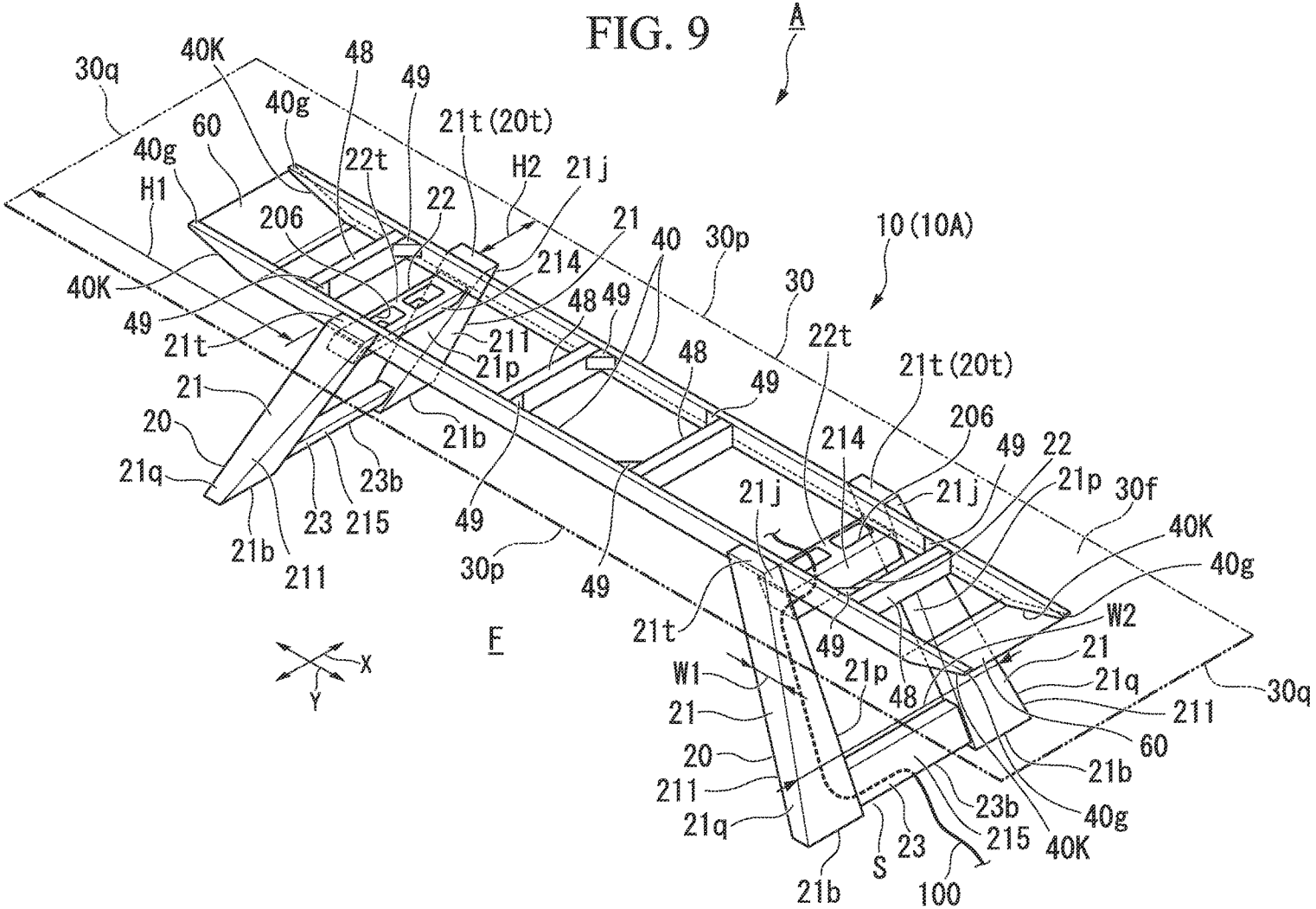
FIG. 9 is a perspective view showing a configuration of legs of the table.
Figure 10:
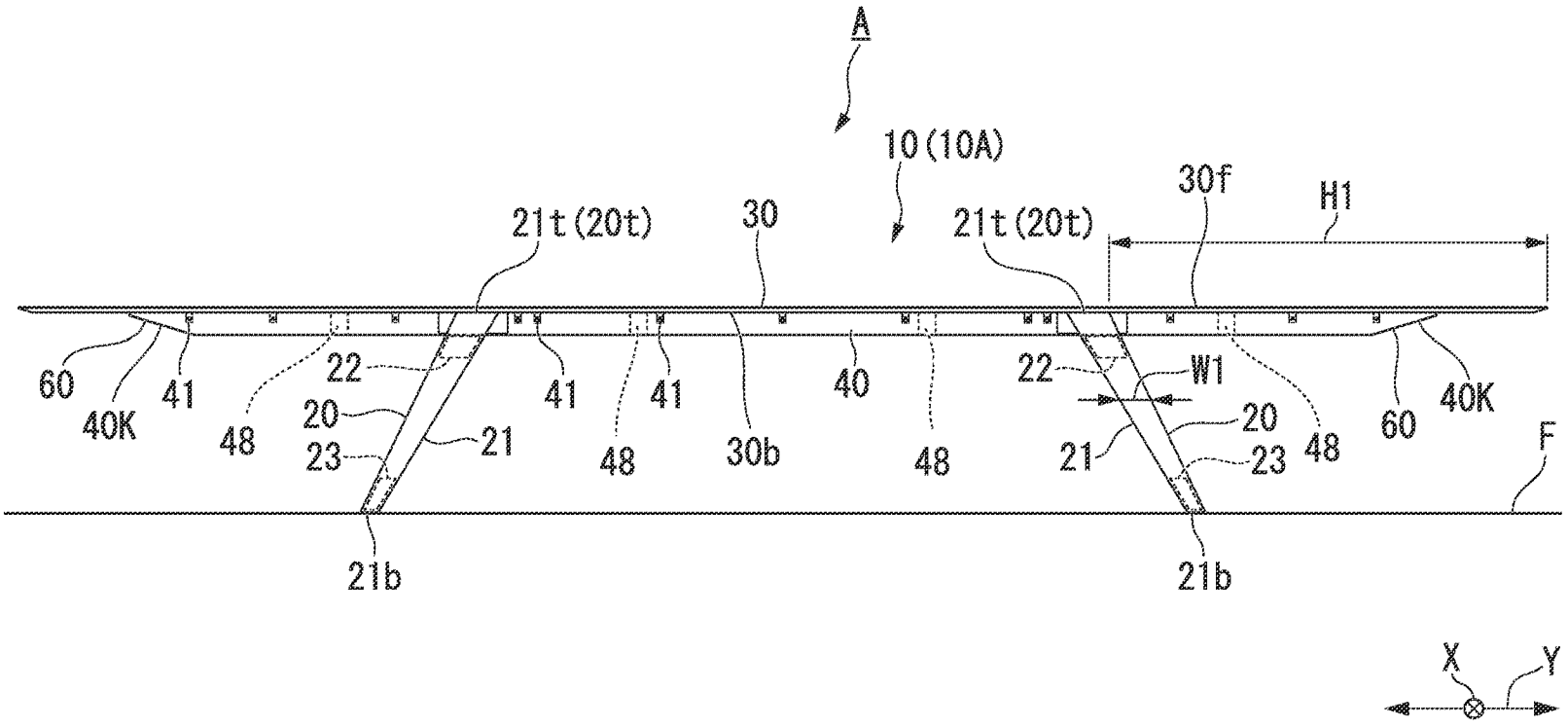
FIG. 10 is a diagram showing the table from a first direction.
Figure 11:
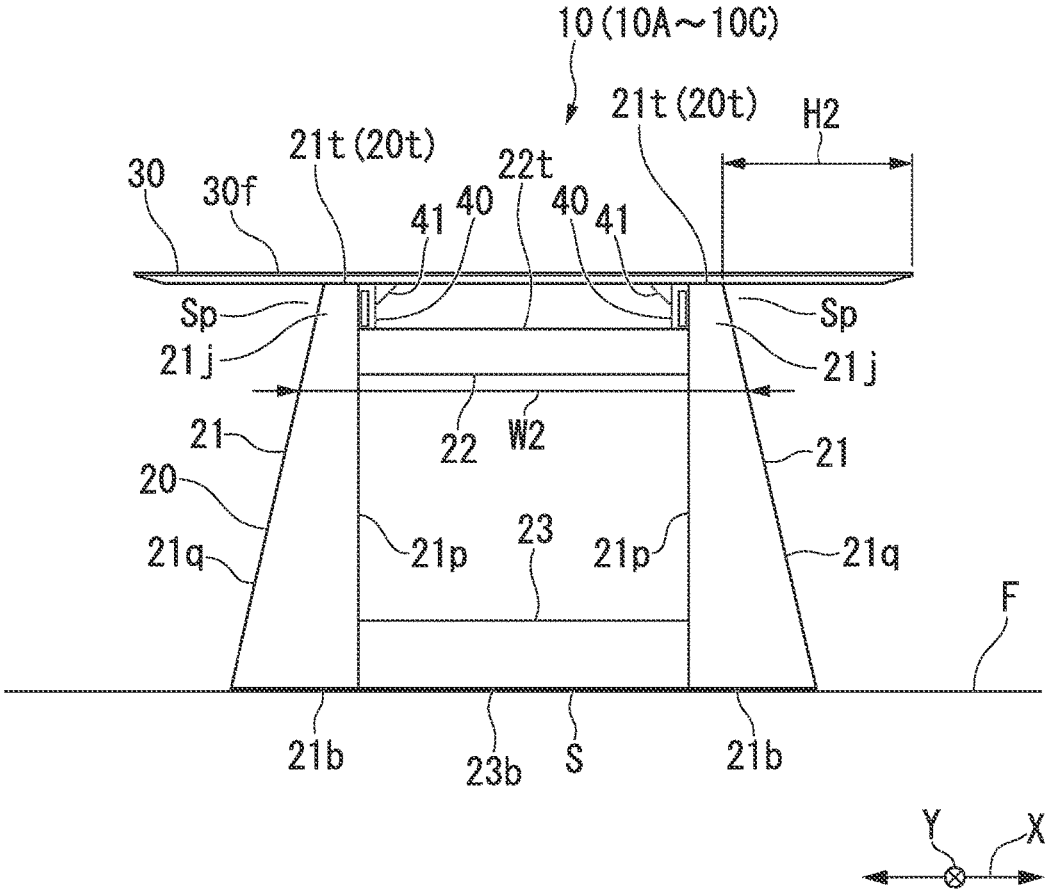
FIG. 11 is a diagram showing the table from a second direction.
Figure 12:
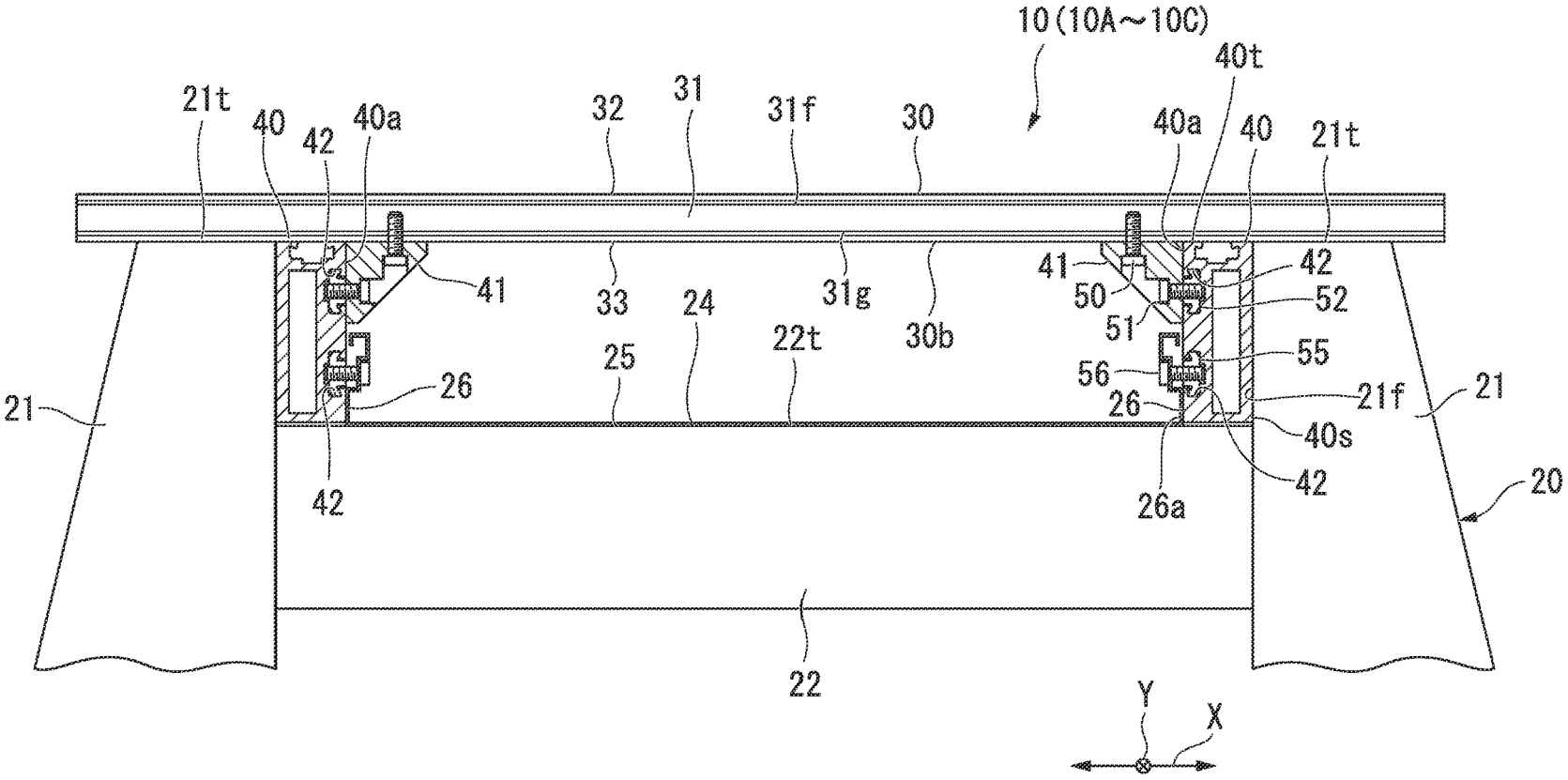
FIG. 12 is a diagram showing a configuration of connection portions between the legs and a tabletop of the table.
Figure 13:
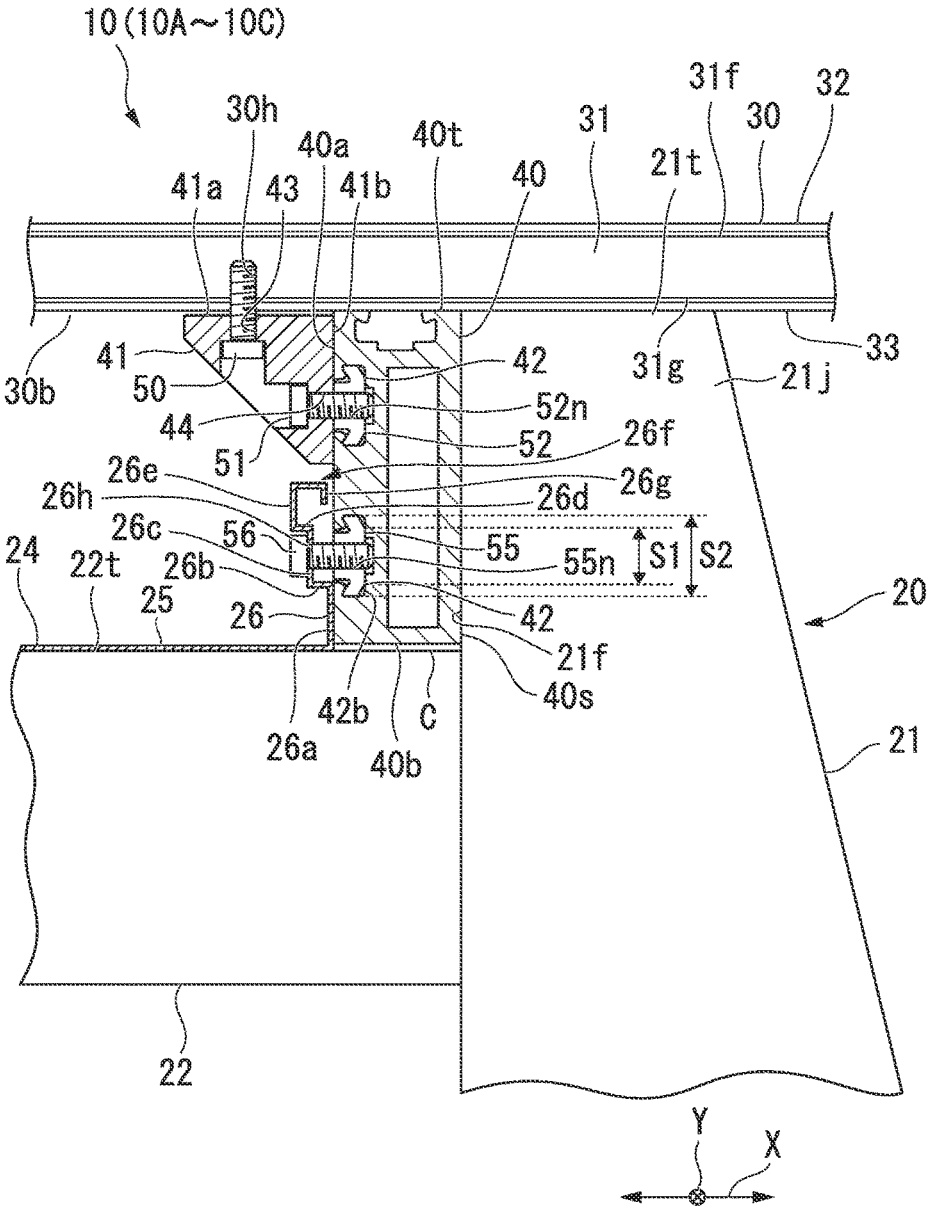
FIG. 13 is an enlarged view showing a main part of a configuration of a connection portion between the legs and a tabletop of the table.
Figure 14:
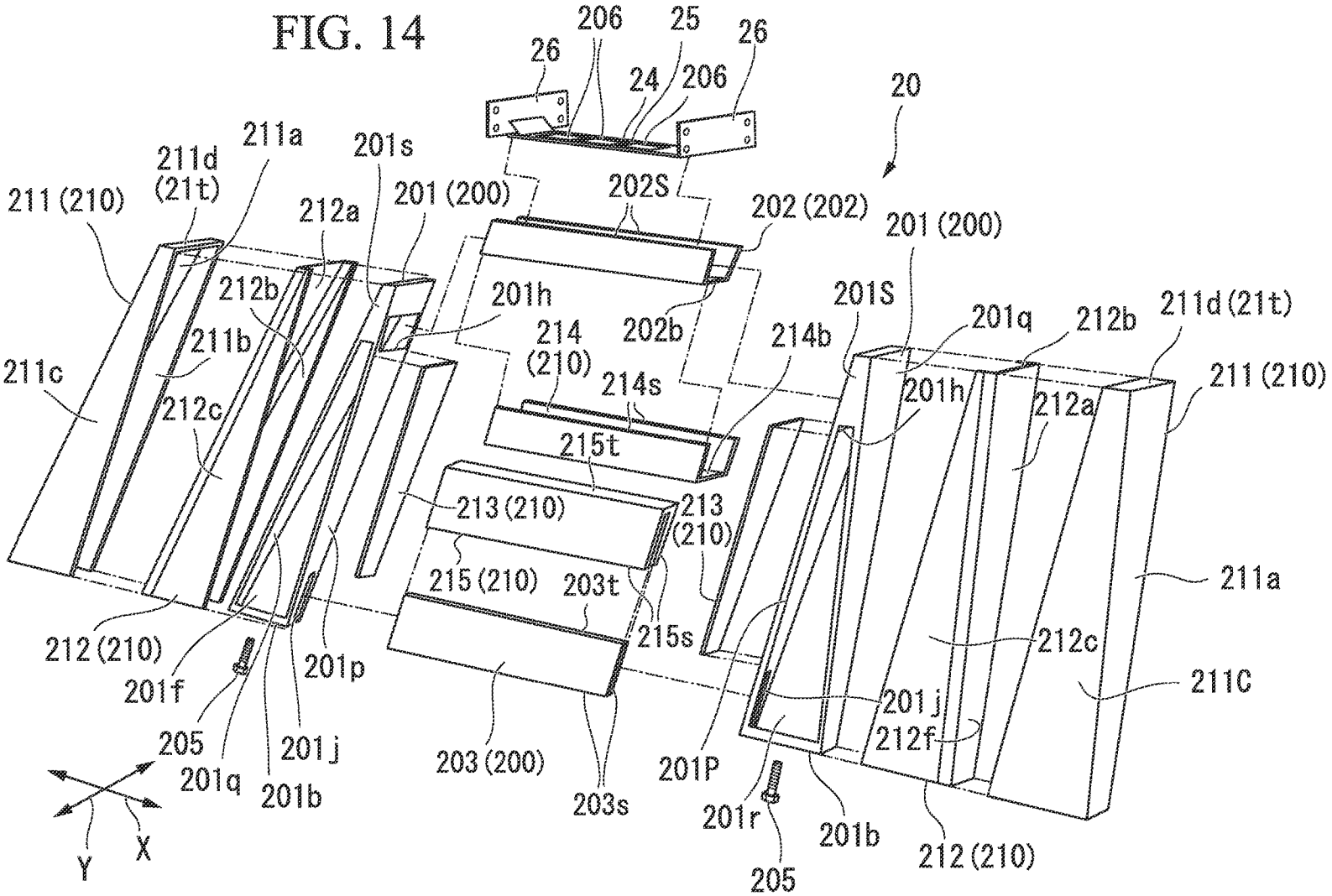
FIG. 14 is a perspective development view showing a component configuration of the legs.
Figure 15:
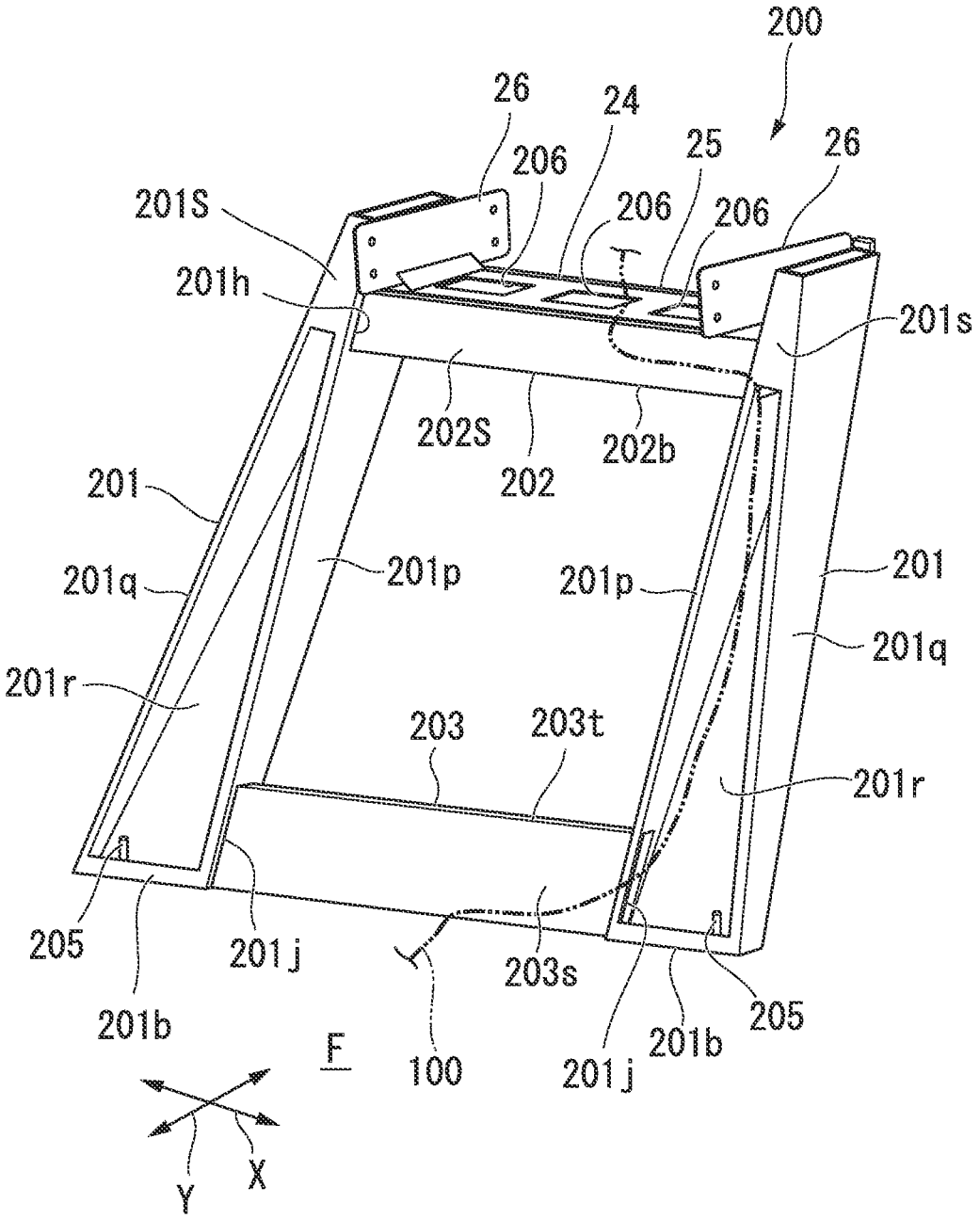
FIG. 15 is a perspective view showing a leg body of the legs.
Figure 16:
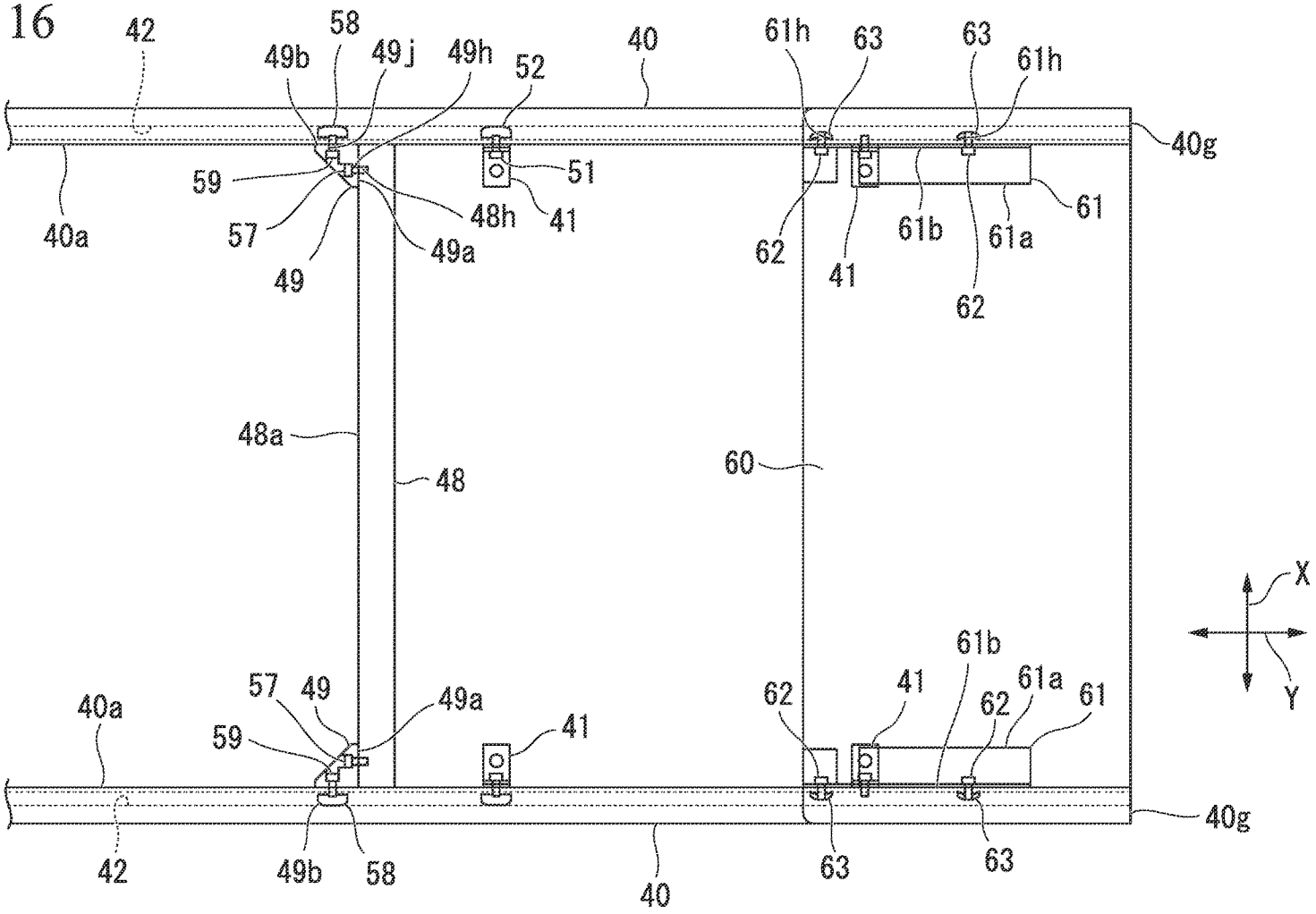
FIG. 16 is a plan view showing end portions of beams provided in a lower surface of the tabletop.
Figure 17:
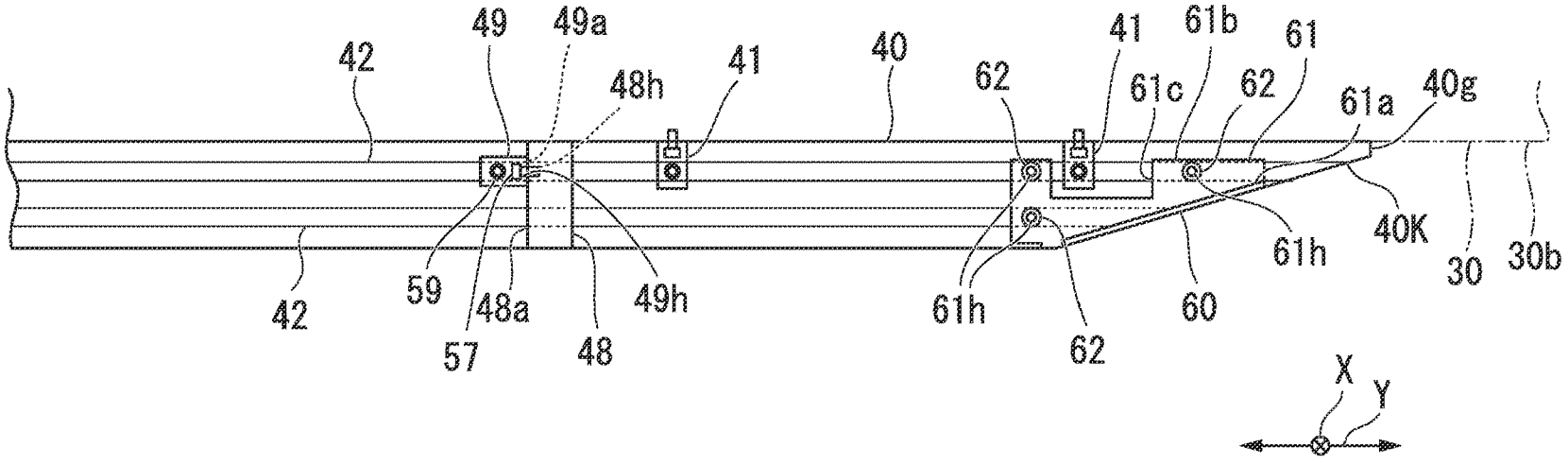
FIG. 17 is a side view showing an attachment structure of an end plate with an end portion of a beam.

FIG. 8 is a perspective view showing an overall configuration of a table according to the second embodiment of the present invention. FIG. 9 is a perspective view showing a configuration of legs of the table. FIG. 10 is a diagram showing the table from a first direction. FIG. 11 is a diagram showing the table from a second direction. FIG. 12 is a diagram showing a configuration of connection portions between a tabletop and the legs of the table. FIG. 13 is an enlarged view showing a main part of a configuration of a connection portion between a leg of the table and the tabletop. FIG. 14 is a perspective development view showing a configuration of components of the legs. FIG. 15 is a perspective view showing a leg body of the legs. FIG. 16 is a plan view showing end portions of beams provided at a lower surface of the tabletop. FIG. 17 is a side view showing an attachment structure of an end plate with an end portion of a beam. As shown in FIGS. 8 to 11, the table (the appliance, the tabletop-equipped article of furniture) 10 which constitutes an appliance system A includes the plurality of legs 20 which stand on the floor surface F and the tabletop (the upper structure) 30 which is supported on the plurality of legs 20.

In the table 10 of the second embodiment, the tabletop 30 has, for example, a rectangular shape in the plan view and is formed to be short in the first direction X along the upper surface 30*f* and to be long in the second direction Y orthogonal to the first direction X within a plane along the upper surface 30*f*. The shape of the tabletop 30 in the plan view is not limited to a rectangular shape, but may be an oval shape, an elliptical shape, or the like.

As shown in FIGS. 12 and 13, the tabletop 30 includes, for example, a panel-shaped core material 31 and skin materials 32 and 33 which cover upper and lower surfaces 31*f* and 31*g*. The core material 31 is formed of an aluminum alloy or a thick paper such as a cardboard or corrugated paper and has a honeycomb structure in which a plurality of holes (not shown) formed in the vertical direction and each having a hexagonal cross-section are arranged within a plane along the surfaces 31*f* and 31*g*. The skin materials 32 and 33 are formed of a resin material or a wood material and are respectively bonded to the upper and lower surfaces 31*f* and 31*g* of the core material 31.

The leg 20 is provided at each of one end side and the other end side of the tabletop 30 in the second direction Y corresponding to the long side direction. Each of the legs 20 includes the leg member 21 provided at each of both end portions in the first direction X corresponding to the short side direction, the upper connection member 22 connecting the upper portions of the leg members 21, and the lower connection member 23 connecting the lower portions of the leg members 21.

As shown, in FIGS. 9 and 11, the upper connection member 22 is provided so that the upper surface 22*t* is located below the upper end (the load receiving portion) 21*t* of the leg member 21 by a predetermined dimension. In other words, the leg member 21 includes an upper extension portion 21*j* provided to extend upward in relation to the upper surface 22*t* of the upper connection member 22.

The lower connection member 23 is provided so that the lower surface 23*b* is located above the lower end 21*b* of the leg member 21 by a predetermined dimension. Accordingly, the gap S is formed between the floor surface F and the lower surface 23*b* of the lower connection member 23 between the leg members 21 while the leg member 21 of the leg 20 contacts the floor surface F. Various wires 100 can be inserted through the lower portion of the lower connection member 23 through the gap S.

As shown in FIGS. 9 and 10, each leg member 21 is formed so that the width dimension W1 in the second direction Y when viewed from the first direction X gradually increases upward from below. Each leg member 21 is provided to be inclined so that the lower end 21*b* is located at the outside in the second direction Y of the table 10 when viewed from the first direction X relative to the upper end 21*t*. Accordingly, the pair of legs 20 facing each other in the second direction Y is disposed in a substantially inverted V shape so that a gap between the legs 20 gradually increases downward from above.

Further, as shown in FIGS. 9 and 11, each leg member 21 is formed such that the inner surface 21*p* located at the inside in the first direction X of the table 10 when viewed from the second direction Y becomes a vertical plane orthogonal to the floor surface F. In the leg member 21, the outer surface 21*q* located at the outside in the first direction X of the table 10 is formed as an inclined surface which is gradually separated from the inner surface 21*p* in a direction along the first direction X from the upper end 21*t* of the leg member 21 toward the lower end 21*b* thereof. Accordingly, the leg 20 is formed so that a width dimension W2 when viewed from the second direction Y gradually increases downward from above.

As shown in FIG. 14, the leg 20 includes a leg body 200 and a leg cover portion 210 which is formed to cover the leg body 200.

As shown in FIGS. 14 and 15, the leg body 200 includes a pair of leg member bodies 201 separated from each other in the first direction X, an upper connection member body 202 which connects the upper portions of the pair of leg member bodies 201, and a lower connect ion member body 203 which connects the lower portions of the pair of leg member bodies 201. In the embodiment the leg body 200 is formed of metal.

Each leg member body 201 includes an inner plate portion 201*p* which follows the inner surface 21*p* (see FIG. 9) of the leg member 21, an outer plate portion 201*q* which follows the outer surface 21*q* (see FIG. 9) of the leg member 21, and a connection plate portion 201*r* which connects the inner plate portion 201*p* and the outer plate portion 201*q* at the inside of the table 10 in the second direction Y and is formed in a substantially U shape. The upper port ion of the leg member body 201 is provided with a blocking plate portion 201*s* which connects the inner plate portion 201*p* and the outer plate portion 201*q* at the outside of the table 10 in the second direction Y. Accordingly, the upper portion of the leg member body 201 is formed in a substantially rectangular shape in the top cross-sectional view.

The upper portion of the inner plate portion 201*p* of the leg member body 201 is provided with a penetration hole 201*h* into which the upper connection member body 202 is inserted. Further, the lower portion of the inner plate portion 201*p* is provided with an opening 201*j* into which the lower connection member body 203 is inserted.

Further, the lower end of the leg member body 201 is blocked by the bottom plate portion 201*b*. An adjustment bolt 205 for adjusting the height and the level of the leg body 200 is threaded into the bottom plate portion 201*b*.

The upper connection member body 202 is integrally provided with a lower plate portion 202*b* and a pair of side plate portions 202*s* extending upward from both ends of the lower plate portion 202*b* in the first direction X and is formed in a U shape to be opened upward in the cross-sectional view. Both end portions of the upper connection member body 202 are respectively inserted into the penetration holes 201*h* formed in the inner plate portion 201*p* of the leg member body 201 and are bonded thereto by welding or the like. In this way, the upper connection member body 202 is opened upward. A base portion 25 of a fixed bracket 24 is fixed onto the side plate portion 202*s* of the upper connection member body 202. Accordingly, a space capable of accommodating the wire or the like is formed among the lower plate portion 202*b* of the upper connection member body 202, the base portion 25 of the fixed bracket 24, and the side plate portion 202*s*. The base portion 25 is provided with an opening portion 206 formed in the vertical direction.

The lower connection member body 203 is integrally provided with an upper plate portion 203*t* and a side plate portion 203*s* extending downward from both ends of the upper plate portion 203*t* in the second direction Y and is formed in a U shape opened downward in the cross-sectional view. Both end portions of the lower connection member body 203 arc respectively inserted into the openings 201*j* formed in the inner plate portion 201*p* of the leg member body 201 to be bonded thereto by welding or the like. In this way the lower connection member body 203 is opened downward.

As shown in FIG. 14, the leg cover portion 210 includes an outer surface cover 211 and a reinforcement member 212 which cover the leg member body 201, an inner surface cover 213 which is disposed along the inner plate portion 201*p* of the leg member body 201, an upper cover 214 which covers the upper connection member body 202, and a lower cover 215 which, covers the lower connection member body 203.

The reinforcement member 212 is formed of metal, is integrally provided with an attachment base portion 212*a* which follows the outer plate portion 201*q* of the leg member body 201, a first side plate portion 212*b* which follows the connection plate portion 201*r*, and a second side plate portion 212*c* which follows a portion opposite to the connection plate portion 201*r* of the leg member body 201, and is formed in a substantially U shape in the top cross-sectional view.

The outer surface cover 211 is integrally provided with an outer cover surface 211*a* which covers the outer plate portion 201*q* of the leg member body 201 and the attachment base portion 212*a* of the reinforcement member 212, a first side cover surface 211*b* which covers the connection plate portion 201*r* and the first side plate portion 212*b*, a second side cover surface 211*c* which covers the second side plate portion 212*c* and a portion opposite to the connection plate portion 201*r* of the leg member body 201, and an upper cover surface 211*d* which covers the upper end of the leg member body 201 and the upper end of the reinforcement member 212.

In the second embodiment, a portion near the leg member body 201 in the outer surface cover 211 is formed of resin and the outer portion thereof is formed of wood. Accordingly, the outer surface cover 211 can ensure strength at the inner portion while exhibiting a wood grain appearance.

The reinforcement member 212 is formed to be fitted to the leg member body 201 from the lateral side. In addition, the attachment base portion 212*a* of the reinforcement member 212 is provided with a magnet (not shown). By this magnet, the reinforcement member 212 is magnetically attached to the outer plate portion 201*q*. Further, a double-faced tape (not shown) is stuck to the upper surface 212*f* opposite to a position facing the outer plate portion 201*q* in the attachment base portion 212*a*. By this double-faced tape, the outer cover surface 211*a* of the outer surface cover 211 is stuck to the reinforcement member 212. Here, the magnet and the double-faced tape may be separately provided at a position feeing the outer plate portion 201*q* in the attachment base portion 212*a* and the upper surface 212*f* at the opposite position thereof. However, the magnet may be stuck to one surface (a single surface) of the double-faced tape and the magnet may be magnetically attached, to the upper surface 212*f* of the attachment base portion 212*a*. In this way, the outer surface cover 211 is attached to the leg member body 201 through the reinforcement member 212. In a state where the outer surface cover 211 is attached to the leg member body 201, the upper cover surface 211*d* of the outer surface cover 211 forms the upper end 21*t* of the leg member 21.

The inner surface cover 213 is formed in a flat plate shape to cover the inner plate portion 201*p* of the leg member body 201 between the upper and lower penetration holes 201*h* and 201*j*. In the second embodiment, in the inner surface cover 213, a portion near the inner plate portion 201*p* in the leg member body 201 is formed of resin and the outer portion thereof is formed of wood. The inner surface cover 213 is provided with a magnet (not shown) at a position facing the inner plate portion 201*p*. By this magnet, the inner surface cover 213 is magnetically attached to the inner plate portion 201*p*.

The upper cover 214 is integrally provided with a lower cover surface 214*b* which follows the lower plate portion 202*b* of the upper connection member body 202 and a side cover surface 214*s* which follows the side plate portion 202*s* of the upper connection member body 202 and is formed in a U shape opened upward in the cross-sectional view. In the second embodiment, a portion near the upper connection member body 202 in the upper cover 214 is formed of resin and the outer portion is formed of wood. The lower cover surface 214*b* of the upper cover 214 is provided with a magnet (not shown) at a position facing the lower plate portion 202*b*. By this magnet, the upper cover 214 is magnetically attached to the lower plate portion 202*b* of the upper connection member body 202.

The lower cover 215 is integrally provided with an upper cover surface 215*t* which follows the upper plate portion 203*t* of the lower connection member body 203 and a side cover surface 215*s* which follows each of the side plate portions 203*s* and 203*s* of the lower connection member body 203 and is formed in a downward U shape in the cross-sectional view. In the embodiment, a portion near the lower connection member body 203 in the lower cover 215 is formed of resin and the outer portion thereof is formed of wood. The lower cover 215 is provided with, for example, a magnet (not shown) at a position facing the upper plate portion 203*t* in the upper cover surface 215*t*. By this magnet, the lower cover 215 is magnetically attached to the upper plate portion 203*t* of the lower connection member body 203.

As shown in FIGS. 9, 14, and 15, the leg 20 (the leg body 200) is formed in, for example, a hollow structure and the wire 100 can be inserted therethrough toward the tabletop 30 (see FIG. 8) from the floor surface F. Specifically, the wire 100 is raised from the floor surface F and is introduced from an opening portion (not shown) formed at the lower surface of the lower connection member body 203 into the lower connection member body 203. Further, the wire 100 passes through the opening 201*j* formed in the inner plate portion 201*p* of the leg member body 201, the inside of the leg member body 201, the penetration, hole 201*h* formed in the inner plate portion 201*p* of the leg member body 201, and the inside of the upper connection member body 202 and is guided toward the upside of the leg body 200 through the opening portion 206 of the fixed bracket 24 on the upper connection member body 202. In this way, the wire 100 following the floor surface F can be guided into the leg 20 through the gap S formed between the floor surface F and the lower connection member 23 (the lower connection member body 203) of the leg member 21.

As shown in FIGS. 9 to 11, she tabletop 30 is provided at the upper end 20*t* of the leg 20 to overhang outward in the first direction X and outward in the second direction Y. In the tabletop 30, the overhang dimension H1 in the second direction Y is set to be larger than the overhang dimension H2 in the first direction X.

In such a table 10, the tabletop 30 is connected to the leg 20 with such a configuration. The lower surface of the tabletop 30 is provided with the beam 40 which extends in the second direction Y of the tabletop 30. The pair of beams 40 is provided to be separated from each other by a predetermined gap in the first direction X of the tabletop 30.

As shown in FIGS. 12 and 13, a cross-section of each beam 40 orthogonal to the second direction Y is formed in a substantially rectangular shape to be long in the vertical direction and to be short in the first direction X and the side surface 40*a* facing the inside of the table 10 in the short side direction is provided with two grooves 42 which are separated from each other in the vertical direction. Each groove 42 is continuously formed in the entire length of the beam 40 along the axial direction of the beam 40, that is, the second direction Y. As shown in FIG. 13, each groove 42 is formed in a dovetail groove shape in which an opening width s2 in the vertical direction near a groove bottom portion 42*b* is wider than an opening width s1 in the vertical direction near the side surface 40*a* of the beam 40.

Each beam 40 is fixed to the tabletop 30 through an attachment metal piece 41 while the upper surface 40*t* abuts against a lower surface 30*b* of the tabletop 30. The attachment metal piece 41 includes a first plane portion 41*a* which abuts against the lower surface 30*b* of the tabletop 30 and a second plane portion 41*b* which is orthogonal to the first plane portion 41*a* and abuts against the side surface 40*a* of the beam 40. The attachment metal piece 41 is formed such that a surface facing the second direction Y has a substantially right triangular shape. The attachment metal piece 41 is provided with a penetration hole 43 penetrating the first plane portion 41*a* in the orthogonal direction and an insertion hole 44 penetrating the second plane portion 41*b* in the orthogonal direction.

A bolt 50 is threaded into a screw hole 30*h* formed in advance in the lower surface 30*b* of the tabletop 30 through the penetration hole 43 of the attachment metal piece 41, so that the attachment metal piece 41 and the tabletop 30 are connected to each other. Further, a seat member 52 provided with a female screw hole 52*n* is inserted into the upper groove 42 of the beam 40 and a bolt 51 is threaded into the seat member 52 inside the groove 42 through the insertion hole 44, so that the attachment metal piece 41 and the beam 40 are connected to each other.

As shown in FIG. 10, such an attachment metal piece 41 is disposed at a plurality of positions at intervals in the long side direction (the second direction Y) of the tabletop 30. Here, the attachment metal pieces 41 are disposed at an interval smaller than that of the legs 20 in the second direction Y. Then, the bolts (the connection members) 50 and 51 and the seat member (the connection member) 52 are fastened in each attachment metal piece 41 as described above, so that the tabletop 30 and the beam 40 are connected to each other through the attachment metal piece 41.

Further, as shown in FIGS. 9 and 10, a plurality of connection beams 48 are provided at intervals in the second direction Y between two beams 40 fixed to the lower surface 30*b* of the tabletop 30. As shown in FIG. 16, each connection beam 48 extends in the first direction X and both end portions thereof are connected to the beam 40 through the connection metal piece 49. Accordingly, two beams 40 and a plurality of connection beams 48 are connected in a trapezoidal shape in the plan view.

The connection metal piece 49 includes a first plane portion 49*a* which abuts against the side surface 48*a* of the connection beam 48 and a second plane portion 49*b* which abuts against the side surface 40*a* of the beam 40 in a direction orthogonal to the first plane portion 49*a* and has a substantially right triangular shape in the plan view. The connection metal piece 49 is provided with an insertion hole 49*h* penetrating the first plane portion 49*a* in the orthogonal direction and an insertion hole 49*j* penetrating the second plane portion 49*b* in the orthogonal direction. Such a connection metal piece 49 may be used by changing the direction of the attachment metal piece 41.

A bolt 57 is inserted through the insert ion hole 49*h* of the connection metal piece 49 and a front end portion thereof is threaded into a screw hole 48*h* formed in advance in the side surface 48*a* of the connection beam 48, so that the connection metal piece 49 and the connection beam 48 are connected to each other. Further, a seat member 58 is inserted into the upper groove 42 of the beam 40 and a bolt 59 is threaded into the seat member 58 inside the groove 42 through the insertion hole 49*j*, so that the connection metal piece 49 and the beam 40 are connected to each other.

As shown in FIGS. 9 and 17, an inclined surface 40*k* which is inclined to approach the lower surface 30*b* of the tabletop 30 as it goes toward a beam end 40*g* in the second direction Y is formed at the lower side of both end portions of each beam 40 in the second direction Y. As shown in FIGS. 9, 16, and 17, both end portions of two beams 40 in the second direction Y are respectively provided with an end cover 60 which blocks a gap between the beam end 40*g* and the inclined surface 40*k* of both end portions in the first direction X along the beam end 40*g* and the inclined surface 40*k* of both end portions in the first direction X.

As shown in FIGS. 16 and 17, the end cover 60 is fixed to both end portions of two beams 40 in the second direction Y through a bracket 61 provided in the upper surface. Each bracket 61 includes a base portion 61*a* which is bonded along the upper surface of the end cover 60 and a plate portion 61*b* which extends upward from the base portion 61*a* in the orthogonal direction and follows the side surface 40*a* of the beam 40. The plate portion 61*b* is provided with an escape recess 61*c* which avoids the interference with the attachment metal piece 41. Further, a plurality of penetration holes 61*h* are formed m the plate portion 61*b* to be located at positions facing the upper groove 42 and the lower groove 42 formed in the side surface 40*a* of the beam 40.

A bolt 62 is inserted into the penetration hole 61*h* of the plate portion 61*b* of the bracket 61 and the bolt 62 is threaded into the seat member 63 disposed in the upper and lower grooves 42 of the beam 40. Accordingly, the end cover 60 is attached to both end portions through the bracket 61.

As shown in FIGS. 12 and 13, the fixed bracket 24 for fixing the beam 40 is provided on the upper surface 22*t* of the upper connection member 22 in the leg 20. The fixed bracket 24 includes the base portion 25 which is fixed to the upper surface 22*t* by a bolt (not shown) along the upper surface 22*t* of the upper connection member 22 and a fixed wall 26 which extends upward from both end portions of the base portion 25 in the first direction X and the base portion 25 and the fixed wall 26 are integrally formed with each other.

As shown in FIG. 13, the fixed wail 26 includes a lower plane portion 26*a* which is raised upward from the end portion of the base portion 25 and follows the side surface 40*a* of the beam 40, an orthogonal wall portion 26*b* which extend s in a direction separated from the side surface 40*a* of the beam 40 from the upper end of the lower plane portion 26*a* in the orthogonal direction, a seat surface portion 26*c* which extend in parallel to the side surface 40*a* of the beam 40 from the end portion of the orthogonal wall portion 26*b*, a second orthogonal wall portion 26*d* which extends in a direction separated from the side surface 40*a* of the beam 40 in the orthogonal direction from the upper end of the seat surface portion 26*c*, a plane portion 26*e* which extends in parallel from the end portion of the second orthogonal wall portion 26*d* to the side surface 40*a* of the beam 40, a third orthogonal wall portion 26*f* which extends from the upper end of the plane portion 26*e* in the orthogonal direction to the side surface 40*a* of the beam 40, and an upper plane portion 26*g* which extends downward from the front end of the third orthogonal wall portion 26*f* along the side surface 40*a* of the beam 40. Further, the lower plane portion 26*a*, the orthogonal wall portion 26*b*, the seat surface portion 26*c*, the second orthogonal wail portion 26*d*, the plane portion 26*e*, the third orthogonal wall portion 26*f*, and the upper plane portion 26*g* are integrally formed with each other. In this way, the lower plane portion 26*a* and the upper plane portion 26*g* which are orthogonal to the upper surface 22*t* are formed at a position facing the upper extension portion 21*j* of the leg member 21 in the fixed wall 26. Further, an insertion hole 26*h* is formed at a predetermined position in the seat surface portion 26*c* of the fixed wall 26.

Further, the upper extension portion 21*j* of the leg member 21 is provided with the plane portion 21*f* at a position facing the fixed wall 26. In other words, the plane portion 21*f* faces an outer sur face 40*s* facing the outside of the beam 40 in the first direction X. A gap between the plane portion 21*f* and each of the lower plane portion 26*a* and the ripper plane portion 26*g* is slightly larger than the width dimension of the beam 40 in the first direction X. In this way, the beam 40 is disposed between the plane portion 21*f* of the leg member 21 and the fixed wall 26 in each leg 20.

Here, the lower surface 30*b* of the tabletop 30 directly abuts against the upper end 21*t* of the leg member 21 so that the load of the tabletop 30 is directly supported by the leg member 21. Further, a lower surface 40*b* of the beam 40 fixed to the lower surface 30*b* of the tabletop 30 through the attachment metal piece 41 has a gap C in the vertical direction between the lower surface 40*b* of the beam 40 and the upper surface 22*t* of the upper connection member 22.

The beam 40 is fixed to the fixed wall 26 by a seat member (a connection tool) 55 and a bolt 56 while the side surface 40*a* abuts against the lower plane portion 26*a* of the fixed wall 26. The seat member 55 is movable in the second direction Y inside the groove 42. The seat member 55 includes a female screw hole 55*h* and is disposed to be inserted into the lower groove 42 of the beam 40. The bolt 56 passes through the insertion hole 26*h* of the fixed wall 26 and is threaded into a female screw hole 55*n* of the seat member 55 inside the groove 42. In this way, the lower plane portion 26*a* abuts against, the side surface 40*a* of the beam 40, the beam 40 and the fixed wall 26 are connected to each other, and the leg 20 is fixed to the beam 40.

Figure 18:
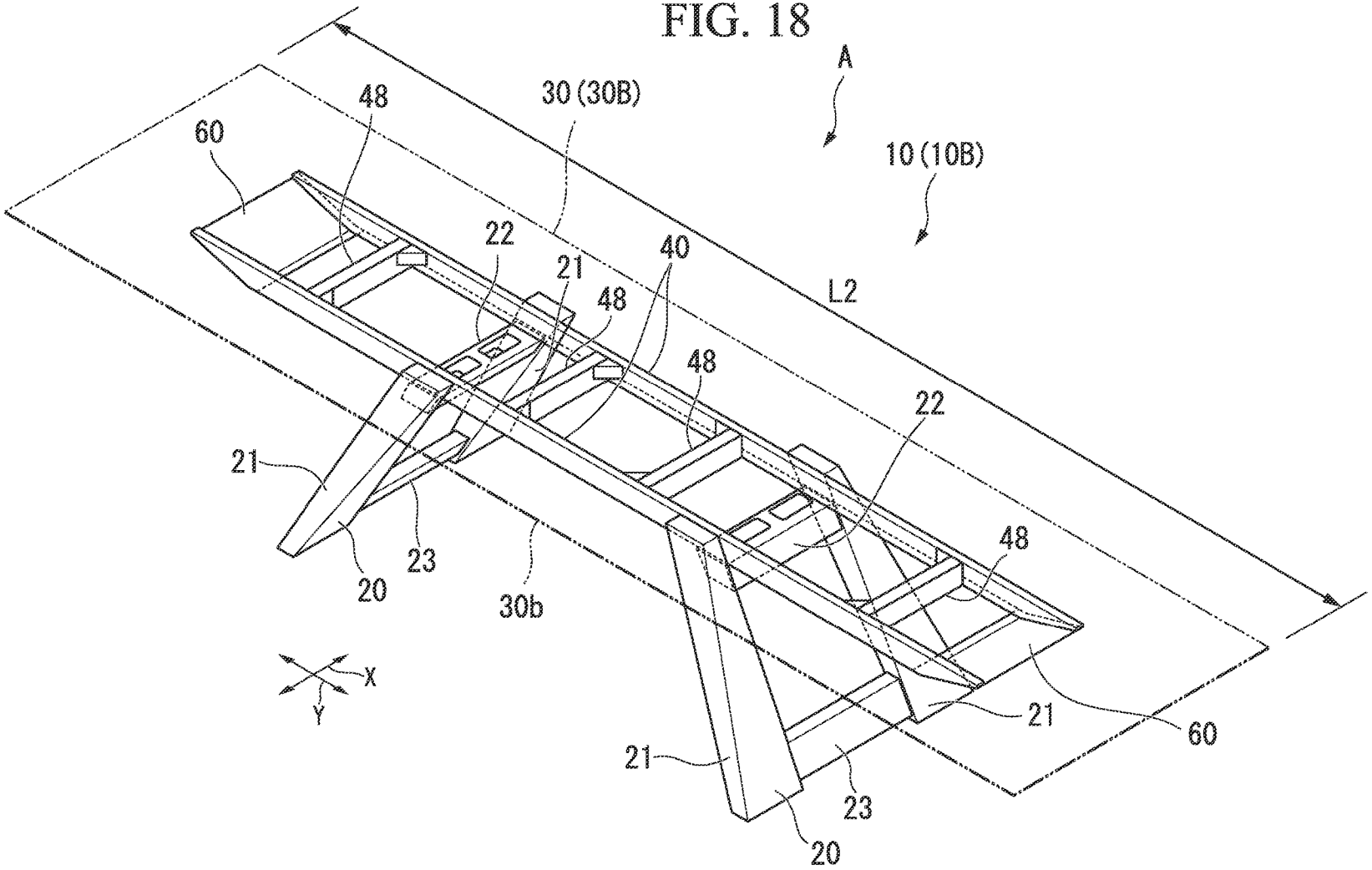
FIG. 18 is a perspective view showing an example of the table in which the legs are connected to positions corresponding to the length of the tabletop when the tabletop has a different length in the table shown in FIGS. 8 to 10.
Figure 19:
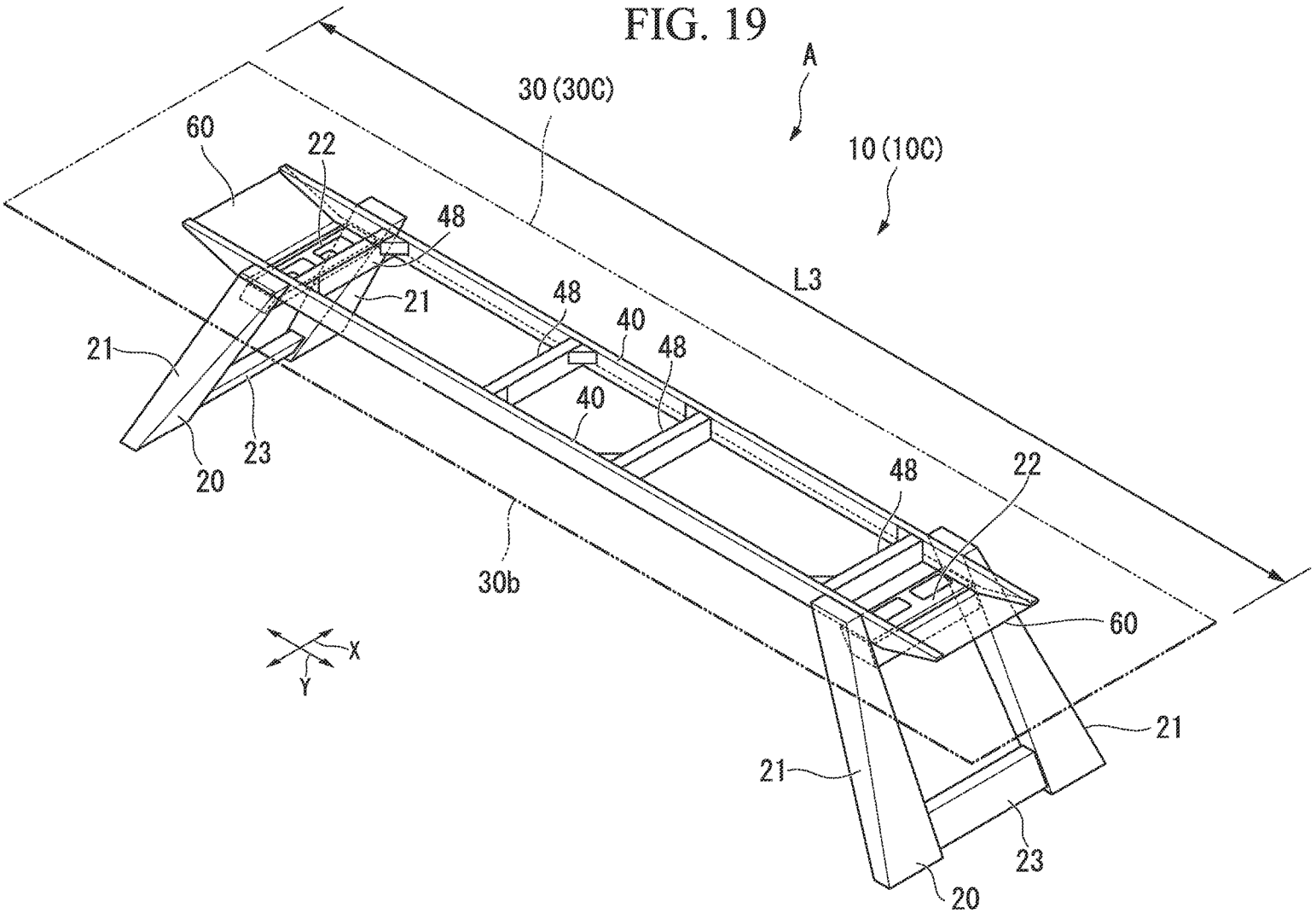
FIG. 19 is a perspective view showing an example of the table in which the legs are connected to positions corresponding to the length of the tabletop when the tabletop has a different length in the table shown in FIGS. 8 to 10 and 18.

By the connection structure between the leg 20 and the beam 40, the leg 20 can be attached to an arbitrary position of the beam 40 in the second direction Y within the range of the groove 42. Accordingly, it is possible to provide the appliance system A capable of constituting the table 10 (the tabletop attached furniture) by using the beam 40 and the leg 20 having the same length even when the length of the tabletop 30 in the second direction Y is different. FIG. 18 is a perspective view showing an example of the table in which the leg is connected to a position corresponding to the length of the tabletop when the tabletop has a different length in the table shown in FIGS. 8 to 10. FIG. 19 is a perspective view showing an example of the table in which the leg is connected to a position corresponding to the length of the tabletop when the tabletop has a different length in the table shown in FIGS. 8 to 10 and 18.

In such an appliance system A, for example, a table (an appliance, a tabletop attached furniture) 10A shown in FIGS. 8 to 10 has a configuration in which a length of a tabletop (an upper structure) 30A in the second direction Y is indicated by L1 (see FIG. 8).

On the contrary, a table (an appliance, a tabletop attached furniture) 10B shown in FIG. 18 has a configuration, in which a length L2 of a tabletop (an upper structure) 30B in the second direction Y is set to be shorter than the length L1 of the tabletop 30A shown in FIGS. 8 to 10. The lower surface 30*b* of the tabletop 30B is also provided with the beam 40 having the same length as that of the beam 40 used in the table 10A and the leg 20 is attached to the beam 40 by a connection structure. Here, the attachment position of the leg 20 with respect to the beam 40 can be changed within the range of the length of the groove 42 in response to the length L2 of the tabletop 30B when the fastening position between the bolt 56 (see FIG. 12) and the seat member 55 (see FIG. 12) with respect to the groove 42 (see FIG. 12) formed in the beam 40 is changed. In the example of FIG. 18, a gap in the second direction Y of the leg 20 is set to be shorter than the gap of the leg 20 in the table 10A shown in FIGS. 8 to 10.

Further, a table (an appliance, a tabletop attached furniture) 10C shown in FIG. 19 has a configuration in which a length L3 of a tabletop (an upper structure) 30C in the second direction Y is set to be shorter than the length L1 of the tabletop 30A shown in FIGS. 8 to 10. The lower surface 30*b* of the tabletop 30C is also provided with the beam 40 having the same length as that of the beam 40 used in the tables 10A and 10B and the leg 20 is attached to the beam 40 by a connection structure. Even in this case, the attachment position of the leg 20 with respect to the beam 40 can be changed within the range of the length of the groove 42 in response to the length L3 of the tabletop 30B when the fastening position between the bolt 56 and the seat member 55 with respect to the groove 42 formed in the beam 40 is changed. In the example of FIG. 19, a gap of the leg 20 in the second direction Y is set to be shorter than the gap of the leg 20 in the table 10A shown in FIGS. 8 to 10.

The appliance system A with the above-described configuration and the table 10 used therein include the plurality of legs 20 which stand on the floor surface F, the tabletop 30 which is supported on the upper portions of the plurality of legs 20 and has an elongated plane shape in the second direction Y in the plan view, and the beam 40 which is formed continuously in the second direction Y along the lower surface 30*b* of the tabletop 30 and is connected to the upper end of the leg 20. In addition, the table 10 has a configuration in which a connection position of the leg 20 with respect to the beam 40 is changeable along the beam 40 in response to the length of the tabletop 30 in the second direction Y in the tabletops 30A, 30B, and 30C having different lengths in the second direction Y According to such a configuration, it is possible to change the connection position of the leg 20 with respect to the beam 40 along the beam 40 in response to the length of the tabletop 30 in the second direction Y while using the beam 40 which has the same length to be commonly used in the tabletops 30A, 30B, and 30C having different lengths in the second direction Y. Thus, the beams 40 having different lengths are not necessary in the tabletops 30A, 30B, and 30C having different lengths m the second direction Y and the length of the beam 40 can be commonly set. Accordingly, when the attachment position of the leg 20 can be easily set to be different in response to various sizes of the tabletops 30A, 30B, and 30C, it is possible to constitute the appliance system A with a small number of components and to commonly set the attachment structure of the beam 40 with respect to the tabletops 30A, 30B, and 30C.

Further the groove 42 is formed in the beam 40 to be continuous to the lower surface 30*b* of the tabletop 30 in parallel and the seat member 55 fastened by the bolt 56 is locked into the groove 42. In this way, it is possible to improve a degree of freedom in the connection position between the beam 40 and the leg 20 by the bolt 56 and the seat member 55. Accordingly, it is possible to easily change the position of the leg 20 with respect to the tabletop 30 within the range along the groove 42.

Further, the seat member 52 is locked to the upper groove 42 and the bolt 51 is threaded into the seat member 52, so that the beam 40 and the tabletop 30 are connected to each other. With such a configuration, it is possible to improve a degree of freedom in the connection position between the tabletop 30 and the beam 40 by the bolt 51 and the seat member 52. Further, the seat member 55 is locked to the lower groove 42 and the bolt 56 is threaded into the seat member 55, so that the leg 20 and the beam 40 are connected to each other. Thus, the seat member 52 which connects the beam 40 and the tabletop 30 to each other is provided in the upper groove 42 and the seat member 55 which connects the leg 20 and the beam 40 to each other is provided in the lower groove 42. For that reason, the bolt 51 and the seat member 52 do not interfere with the bolt 56 and the seat member 55.

Further, the tabletop 30 is formed in a plane shape so that the second direction Y is the long side direction and the first direction X is the short side direction within the horizontal plane. In addition, the beam 40 is continuously formed in the long side direction along the lower surface 30*b* of the tabletop 30. With such a configuration, the tabletop 30 which is elongated in one direction can be reinforced by the beam 40 to be strongly supported. Further, when the beam 40 serving as a reinforcement component of the tabletop 30 is used for the connection with the fixed wall 26 in this way, it is possible to suppress an increase in number of components constituting the table 10.

Further, since the width dimension W1 of the leg 20 when viewed from the first direction X gradually increases upward from below in the table 10 as shown in FIG. 11, it is possible to ensure strength at the joint portion between the upper portion of the leg 20 and the tabletop 30. Further, since the width dimension W2 of the leg 20 decreases at the lower portion of the leg 20, it is possible to suppress the interference between the lower leg of the user and the leg 20. Further, since the width dimension W2 of the leg 20 when viewed from the second direction Y gradually increases downward from above as shown in FIG. 10, the upper portion of the leg 20 is located at the inside of the tabletop 30 in the first direction X and thus an upper space close to the tabletop 30 can be widely ensured. Thus, the knee and so on of the lower leg of the user hardly interferes with the leg 20. With such a configuration, it is possible to ensure the lower leg accommodation space Sp for accommodating the lower leg of the user below the tabletop 30 while ensuring strength.

Here, the first direction X is the short side direction of the tabletop 30 and the second direction Y is the long side direction of the tabletop 30. With such a configuration, the joint portion between the leg 20 and the tabletop 30 has high strength against a load or force in the vertical direction and the second direction Y, that is, the long side direction of the tabletop 30 corresponding to the second direction Y. In the leg 20, the lower leg of the user facing the tabletop 30 in the short side direction of the tabletop 30 corresponding to the first direction X hardly interferes with the upper portion of the leg 20. Additionally, in the tabletop 30 having an elongated shape in one direction in this way the number of the users facing the tabletop 30 at the long side 30*p* along the long side direction (the second direction Y) is generally larger than the number of the users feeing the tabletop 30 at the short side 30*q* along the short side direction (the first direction X). That is, the first direction X is a direction lacing the tabletop 30 from a frequently used side and the second direction Y is a direction facing the tabletop 30 from a less frequently used side. Accordingly, the lower leg of the user facing the tabletop 30 hardly interferes with the leg 20 when viewed from a side where a large number of users may use the tabletop 30.

Further, the first direction X is a direction facing the leg 20 from a side where the overhang dimension H2 of the tabletop 30 overhanging laterally is small and the second direction Y is a direction feeing the leg 20 from a side where the overhang dimension H1 of the tabletop 30 overhanging laterally is large. Since the width dimension W1 of the leg 20 when viewed from the first direction X gradually increases upward from below, the leg 20 has high strength at the joint portion with respect to the tabletop 30 against a load or force in the second direction Y and the vertical direction. Thus, the leg 20 can effectively exhibit strength against a load or force applied to a portion in which the overhang dimension H2 of the tabletop 30 is large.

Further, in the table 10, each leg 20 is provided to be inclined so that a gap between the pair of legs 20 facing each other in the second direction Y gradually increases downward from above. With such a configuration, a force of widening the pair of legs 20 in the second direction Y is exhibited by a load or the like acting on the tabletop 30. Since the width dimension W1 of the leg 20 when viewed from the first direction X gradually increases upward from below, the leg 20 has high strength at the joint portion with respect to the tabletop 30 against a force or load in the second direction Y and the vertical direction. Thus, since a gap between the pair of legs 20 gradually increases downward from above, the legs 20 cannot be easily widened in the second direction Y and thus can exhibit high strength.

(Other Embodiments)

Additionally, the appliance of the present invention is not limited to the second embodiment described with reference to the drawings and various modifications can be considered within the technical scope.

For example, in the second embodiment, the connection structure between the leg 20 and the beam 40 using the groove 42 has been described, but the connection structure may be arbitrarily changed as long as the connection position of the leg 20 with respect to the beam 40 can be easily changed.

Further, in the second embodiment, the appliance system A includes three kinds of tabletops 30A, 30B, and 30C, but may be of one type. Also in this case, since it is possible to provide the leg at a predetermined position in one direct ion of the beam, the leg can be provided at an appropriate position in response to the shape, size, and load distribution of the tabletop. Further, since the tabletop can be provided at a predetermined position of the beam in one direction, it is possible to provide legs at appropriate positions according to usability and the like.

Further, for example, the leg 20 may be formed as a panel body having a trapezoidal shape when viewed from the first direction X or the second direction Y. In addition, the shape of the leg 20 when viewed from the first direction X or the second direction Y is not limited to the shape indicated by the second embodiment. Further, in the second embodiment the pair of legs 20 facing each other in the second direction Y is provided so that a gap between the legs 20 is gradually widened downward from above and is disposed in a substantially inverted V shape. However, the present invention is not limited thereto. The pair of legs 20 may be disposed in parallel to extend upward in the vertical direction from the floor surface F. Further, the pair of legs 20 may be disposed in a substantially V shape so that a gap between the legs 20 gradually decreases downward from above. Further, in the second embodiment, the table 10 includes two legs 20, but the number of the legs 20 is not limited thereto. The table 10 may include, for example, one leg 20 or three or more legs 20. When only one leg 20 is provided, the leg 20 is disposed at the center portion of the tabletop 30 in the first direction X and the second direction Y. In this case, it is desirable that a thickness dimension of the leg 20 in the first direction X and the second direction Y be sufficiently large so that the leg 20 stably supports the tabletop 30.

In addition, a material of a member such as the leg 20 and the tabletop 30 constituting the table 10 indicated by the second embodiment is not limited. Such a member may be formed of, for example, a wood material a metal material, a resin material, or a combination thereof. Additionally, the present invention is not limited to the table 10 and can be also applied to other tabletop attached furniture (appliances) such as a counter. Further, the tabletop 30 has been exemplified as the upper structure, but may be an appliance having a different upper structure, for example, having a box shape as long as the tabletop is supported on the leg 20. In addition, a configuration exemplified in the second embodiment and the modified example thereof may be selected or may be replaced by other configurations without departing from the spirit of the present invention.

INDUSTRIAL APPLICABILITY

According to the tabletop attached furniture of the present invention, it is possible to ensure the lower leg accommodation space for accommodating the lower leg of the user below the tabletop while ensuring the strength of the leg. In addition, according to the tabletop attached furniture (the appliance constituting the appliance system) of the present invention, the leg attachment position can be easily changed in response to the shape or size of the upper structure like the tabletop.

REFERENCE SIGNS LIST

10, 10A, 10B, 10C Table (appliance, tabletop attached furniture)
20 Leg
21 Leg member (leg portion)
22 Upper connection member (connection member)
23 Lower connection member (connection member)
23*b* Lower surface
28 Panel body
30, 30A, 30B, 30C Tabletop (upper structure)
30*b* Lower surface
30*f* Upper surface
40 Beam
51 Bolt (connection member)

52 Seat member (connection member)
55 Seat member (connection tool)
56 Bolt
100 Wire
F Floor surface
H1 Overhang dimension
H2 Overhang dimension
S Gap
Sp Lower leg accommodation space
W1 Width dimension
W2 Width dimension
X First direction
Y Second direction (one direction)
A Appliance system

The invention claimed is:

1. A table top-equipped article of furniture comprising:
a plurality of legs which stand on a floor surface;
a table top which is supported on the plurality of legs; and beams,
wherein each of the legs is formed so that a width dimension when viewed from a first direction along an upper surface of the tabletop gradually increases upward from below and a width dimension when viewed from a second direction orthogonal to the first direction within a plane along the upper surface of the tabletop gradually increases downward from above,
wherein the beams are connected to the legs and extend in one direction intersecting a vertical direction, each of the beams including a groove which extends in the one direction, wherein:
the tabletop is supported by the beams; and
the tabletop-equipped article of furniture further comprises connection tools which are inserted into the grooves in a movable manner along the grooves and are configured to connect the legs with the beams, thereby connection positions of the legs with the beams are changeable along the beams in response to a length of the tabletop in the one direction when the tabletop has different lengths in the one direction.

2. The tabletop-equipped article of furniture according to claim 1,
wherein the first direction is a direction facing the tabletop from a frequently used side and the second direction is a direction facing the tabletop from a side used less frequently than the frequently used side.

3. The tabletop-equipped article of furniture according to claim 1,
wherein the first direction is a direction facing the legs from a side where an overhang dimension of the tabletop overhanging laterally is small and the second direction is a direction facing the legs from a side where the overhang dimension of the tabletop overhanging laterally is large.

4. The tabletop-equipped article of furniture according to claim 1, wherein the first direction is a short side direction of the tabletop and the second direction is a long side direction of the tabletop.

5. The tabletop-equipped article furniture according to claim 1,
wherein the legs are provided to be inclined so that gaps between pairs of the
legs facing each other in the second direction gradually increase downward from above.

6. The tabletop-equipped article of furniture according to claim 1,
wherein the legs are formed as panel bodies which have trapezoidal shapes when
viewed form the first direction or the second direction.

7. The tabletop-equipped article of furniture according to claim 1,
wherein the legs include pairs of leg portions separated from each other in the first direction and connection members connection the pairs of leg portions to each other.

8. The tabletop-equipped article of furniture according to claim 7,
wherein, when lower surfaces of the connection members are formed above lower
ends of the leg portions and the legs are installed on the floor surface, gaps are formed between the floor surface and the lower surfaces of the connection members.

9. The tabletop-equipped article of furniture according to claim 1, wherein each of the legs is provided to be inclined so that, when viewed from the first direction, a lower end of the leg is located at an outside in a width direction of the tabletop in the second direction relative to an upper end of the leg.

10. The tabletop-equipped article of furniture according to claim 1, wherein each of the legs is formed such that, when viewed from the second direction, an inner surface of the leg located at an inside in a width direction of the tabletop in the first direction is a vertical plane orthogonal to the floor surface, and an outer surface of the leg located at an outside in the width direction of the tabletop in the first direction is formed as an inclined surface which is gradually separated from the inner surface in a direction along the first direction from an upper end of the leg toward a lower end of the leg.

* * * * *